US006932541B2

(12) United States Patent
McFarland

(10) Patent No.: US 6,932,541 B2
(45) **Date of Patent: *Aug. 23, 2005**

(54) WAVE FORMING APPARATUS AND METHOD

(76) Inventor: Bruce C. McFarland, 615 Marvista Dr., Solana Beach, CA (US) 92075

( * ) Notice: Subject to any disclaimer, the term of this patent is extended or adjusted under 35 U.S.C. 154(b) by 43 days.

This patent is subject to a terminal disclaimer.

(21) Appl. No.: 10/372,549

(22) Filed: Feb. 24, 2003

(65) Prior Publication Data

US 2003/0198515 A1 Oct. 23, 2003

Related U.S. Application Data

(63) Continuation-in-part of application No. 10/103,600, filed on Mar. 19, 2002, now Pat. No. 6,629,803.

(51) Int. Cl.[7] ..... E02B 3/00
(52) U.S. Cl. ..... 405/79; 472/117
(58) Field of Search ..... 405/79, 76; 4/491; 472/117, 128

(56) References Cited

U.S. PATENT DOCUMENTS

| | | | | |
|---|---|---|---|---|
| 3,350,724 A | | 11/1967 | Leigh | |
| 3,913,332 A | | 10/1975 | Forsman | |
| 4,954,014 A | | 9/1990 | Sauerbier et al. | |
| 5,171,101 A | | 12/1992 | Sauerbier et al. | |
| 5,271,692 A | | 12/1993 | Lochtefeld | |
| 5,342,145 A | | 8/1994 | Cohen | |
| 5,421,782 A | | 6/1995 | Lochtefeld | |
| 5,564,859 A | | 10/1996 | Lochtefeld | |
| 5,667,445 A | | 9/1997 | Lochtefeld | |
| 5,913,636 A | | 6/1999 | Macaulay | |
| 6,019,547 A | * | 2/2000 | Hill | 405/79 |
| 6,132,317 A | | 10/2000 | Lochtefeld | |
| 6,336,771 B1 | * | 1/2002 | Hill | 405/79 |
| 6,460,201 B1 | * | 10/2002 | Lochtefeld | 4/491 |
| 6,491,589 B1 | * | 12/2002 | Lochtefeld | 472/117 |
| 6,629,803 B1 | * | 10/2003 | McFarland | 405/79 |

* cited by examiner

*Primary Examiner*—Heather Shackelford
*Assistant Examiner*—Lisa M. Saldano
(74) *Attorney, Agent, or Firm*—Gordon & Rees LLP

(57) ABSTRACT

A wave forming apparatus has a channel for containing a flow of water with an inlet end connected to a water supply, a base, and spaced side walls, a weir in the base at the inlet end of the channel, and at least one bed form in the channel downstream of the weir. The bed form has an upwardly inclined upstream face extending downstream of the leading end, an upper portion, and a downwardly inclined downstream face extending from the upper portion to the trailing end. A primary flow path for water extends over the weir and bed form. A secondary flow passageway extends through the bed form, with a first end adjacent the trailing end of the bed form, and a second end in the bed form upstream of the first end.

64 Claims, 10 Drawing Sheets

WAVE FORMING APPARATUS AND METHOD

CROSS REFERENCE TO RELATED APPLICATIONS

This application is a Continuation-In-Part of application Ser. No. 10/103,600 filed Mar. 19, 2002 now U.S. Pat. No. 6,629,803.

BACKGROUND OF THE INVENTION

The present invention relates generally to a wave forming apparatus and is partially concerned with water rides of the type provided in water-based amusement parks, particularly a wave forming apparatus and method for forming surfable waves, or a water toy.

Naturally occurring waves occur in the ocean and also in rivers. These waves are of various types, such as moving waves which may be of various shapes, including tubular and other breaking waves. A relatively rare type of wave in nature is the standing wave, which has a steep, unbroken and stable wave face. This type of wave can have enough power and velocity to support surfing on the wave face without causing the wave to decay rapidly. This wave, if forced to decay, for example by overly obstructing the flow, reforms naturally when the obstructions are removed. Natural standing waves have been shown to occur where water flows across natural river bed formations, known as anti-dunes. Upon flow over anti-dunes, the water flow rises into a natural standing wave. Natural standing waves occur in the Waimea Bay river mouth of the Waimea River on the Hawaiian island of Oahu, on the Snake River in Wyoming, and several other places.

Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. This type of apparatus is described, for example, in U.S. Pat. Nos. 5,564,859 and 6,132,317 of Lochtefeld. In some cases, the inclined surface is shaped to cause a tubular form wave. Sheet flow wave simulating devices have some disadvantages. For example, since these systems create a fast moving, thin sheet of water, they produce a different surfing experience to a real standing wave.

In other prior art wave forming devices, a wave is actually simulated in the water itself, rather than being defined by a surface over which a thin sheet of water flows. U.S. Pat. No. 6,019,547 of Hill describes a wave forming apparatus which attempts to simulate natural antidune formations in order to create waves. A water-shaping airfoil is disposed within a flume containing a flow of water, and a wave-forming ramp is positioned downstream of the airfoil structure. In other prior art arrangements, such as U.S. Pat. No. 3,913,332 of Forsman, a wave generator is driven around a circular body of water in order to create waves. This arrangement is also complex and will produce traveling waves, not standing waves.

SUMMARY OF THE INVENTION

It is an object of the present invention to provide a new and improved wave forming apparatus and method.

According to one aspect of the present invention, a wave forming apparatus is provided, which comprises a channel for containing a flow of water, the channel having an inlet end connected to a water supply, a base, and spaced side walls, a weir in the base at the inlet end of the channel, and at least one bed form in the channel downstream of the weir, the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form, and a secondary flow passageway provided in the channel, the secondary flow passageway having a first end communicating with the primary water flow at a location adjacent the trailing end of the bed form, and a second end communicating with the primary water flow at a location upstream of the first end.

In an exemplary embodiment of the invention, the first end of the secondary flow passageway comprises a first vent extending across the full width of the bed form. The second end may comprise a second vent extending across the full width of the bed form, or may comprise spaced second vents adjacent opposite sides of the bed form, each vent extending across the upper portion of the bed form. The first and second vents may be connected together via ducting or passageways through the bed form. Alternatively, the bed form may comprise a hollow shell so that the vents communicate via the chamber within the hollow shell.

This arrangement will tend to create a standing wave at the leading end of the bed form and any subsequent bed form. The provision of a secondary flow channel within the bed form communicating with a vent at the trailing edge of the bed form will enhance production of a stable standing wave at the next bed form in the channel, where two or more successive bed forms are provided. A secondary flow passageway may also be provided in the weir. In the exemplary embodiment, the side walls of the channel do not extend vertically upwardly from the top of the bed forms, but instead have outwardly angled, shallow inclined portions which taper slowly upwardly from the opposite sides of the weir and bed forms. Alternatively, the side portions on opposite sides of the channel extend outwardly either horizontally or at a slightly downwardly inclined angle on opposite sides of the channel containing the bed forms. In practice, the outer side portions or side walls may extend outwardly from the channel at an angle relative to the horizontal of +10° to −5°. This has been found to enhance the standing wave formation capabilities of the apparatus, and also provides a shallow lead-in portion for individuals prior to riding a standing wave, and for exiting the ride.

Water flows along the secondary flow passageway in either direction, depending on the conditions. It has been found that the provision of the secondary flow path enhances the formation of a stable standing wave at the upstream face of the bed form, and at any other bed forms downstream of the first bed form. Thus, additional secondary flow passageways will be provided, one for each wave-forming bed form. Adjustable valves or the like may be provided in the secondary flow passageways in order to vary the secondary flow rate. Additionally, several separate gates may be provided across the width of the first vent or the flow passageway, and these gates, if closed sequentially, can produce a lateral breaking wave.

In an exemplary embodiment of the invention, the trailing end of the bed form has an abrupt vertical drop off, such that the uppermost region of the trailing end is raised up above the channel bottom by a predetermined tail elevation. This has been found to enhance the standing wave formation properties of the apparatus. In fact, with an abrupt trailing end drop off in the waveform in a predetermined elevation range, the secondary passageways may be eliminated altogether, and standing waves may still be created. The tail elevation factor (TEF), or ratio of the top surface distance at the trailing end of the bed form above the channel bottom to the elevation of the top or peak of the next bed form above the channel bottom, may be in the range from 0.125 to 0.75 while still producing a rideable standing wave. Waves will still be produced at ratios above 0.75.

The tail elevation need not be constant across the entire width of the bed form. For example, TEF may be zero at one side of the channel and 0.8 at the other side. The tail elevation may be permitted to self-adjust based on water pressure. This will produce an oscillating wave.

In an exemplary embodiment of the invention, a series of identical bed forms are provided at spaced intervals along the channel, so that a series of standing waves may be formed. The channel cross section may be deeper in the wave forming area than at the outer sides of the bed forms, and may have gradually outwardly sloping side walls. This tends to return water to the center of the flume or channel, and also prevents too much water from escaping around the sides of the bed forms.

According to another aspect of the present invention, a method of forming waves is provided, which comprises the steps of directing water from a reservoir at one end of a channel having a base and spaced side walls into the channel and over a weir at the inlet end of the channel, directing water in the channel in a primary flow path over at least one bed form in the channel downstream of the weir, the bed form having a leading end and a trailing end, an upwardly inclined upstream face extending downstream of the leading end, an upper portion, and a downwardly inclined downstream face extending from the upper portion to the trailing end, and directing a secondary flow of water along a secondary flow passageway having a first end communicating with the primary water flow at a location adjacent the trailing end of the bed form, and a second end communicating with the primary water flow at a location upstream of the first end, whereby a stable standing wave is formed downstream of the bed form.

The apparatus and method of this invention may be modified in order to create a standing curling wave or tubing wave. In one embodiment, an oblique shaped bedform is positioned in the channel at a position where a standing curling wave is desired. This gives the water a sideways velocity component that induces the more downstream side to break continuously while the more upstream side remains an unbroken standing curl. Alternatively, another channel may intersect the end of the primary channel at an oblique angle, with a deeper river flow along the secondary channel. A curling wave is created at the confluence of the faster, primary channel or flume flow and the deeper river flow.

This invention provides a wave generating apparatus and method particularly suitable for use in water park rides and the like which is able to produce more consistent and controllable standing waves than was possible in the past. The waves will be of good quality, enabling surfers to ride for a longer period of time without the wave decaying.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
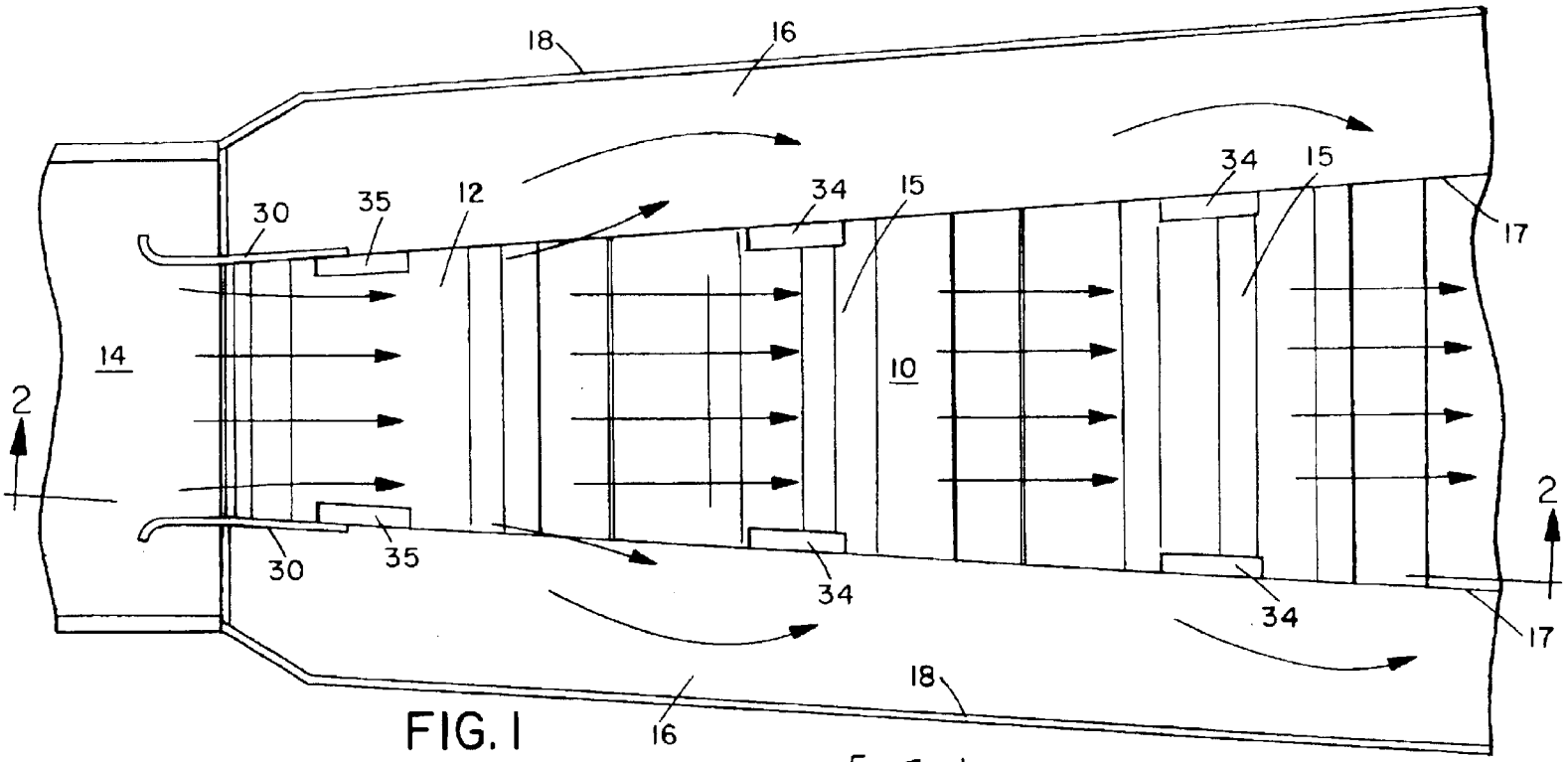
FIG. 1 is a top plan view of a wave forming apparatus according to a first exemplary embodiment of the invention.
Figure 2:
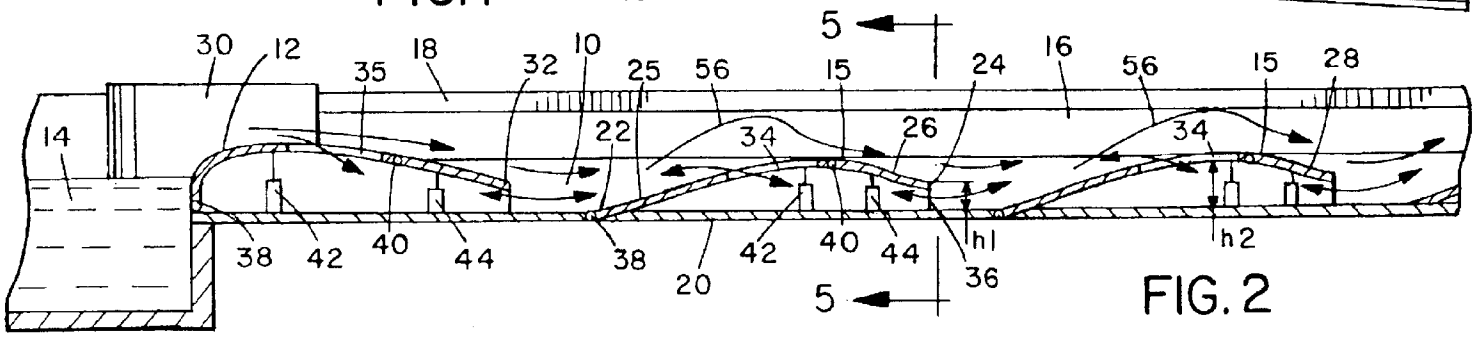
FIG. 2 is a sectional view taken along lines 2—2 of FIG. 1, showing the basic water flow.
Figure 5:
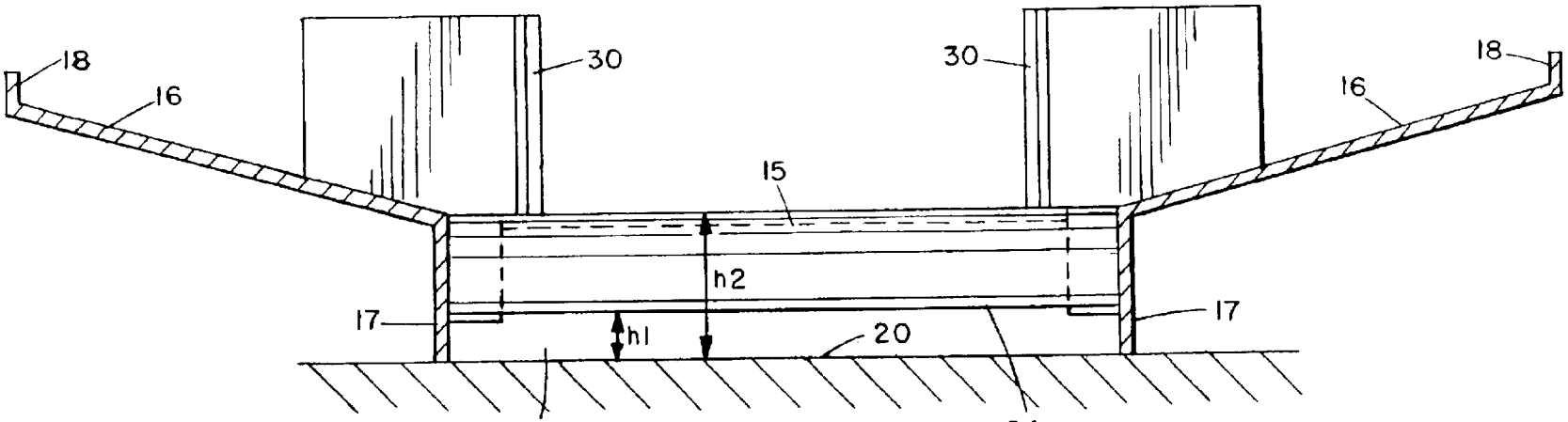
FIG. 5 is an enlarged sectional view taken on lines 5—5 of FIG. 2.

FIGS. 1, 2 and 5 illustrate a wave forming apparatus according to a first embodiment of the invention for forming rideable, standing waves. The apparatus basically comprises a channel 10 for containing a flow of water, the channel having a weir 12 at its inlet end connected to a supply of water in a reservoir 14, and a series of spaced bed forms 15 in the channel downstream of the weir. Sloping side walls or entry/exit portions 16 extend outwardly from opposite sides 17 of the wave forming channel 10 to the outer sides 18 of the apparatus, which are spaced outwardly from the outer sides of channel 10, as best illustrated in FIGS. 1 and 5.

As best illustrated in FIG. 2, the channel 10 has a base or lower wall 20 and the weir 12 and bed forms 15 are provided at spaced intervals along the channel, mounted in the base of the channel and extending between the opposite side walls of the channel, to define a primary flow path for water over the weir and the bed forms. In the embodiment of FIGS. 1, 2 and 5, the opposite sides 17 of the channel 10 are shown to taper outwardly from the inlet end of the channel, at weir 12, to the opposite end of the channel. However, the sides 17 may alternatively be straight, as in the embodiment of FIGS. 15 and 16, discussed in more detail below, or taper inwardly.

The bed forms 15 are each of similar or identical shape and have a leading end 22 and a trailing end 24, with an upstream face 25 inclined upwardly to a peak or upper portion, and a downstream face 26 with a downwardly inclined, convex curvature extending from the peak towards the trailing end 24. As best illustrated in FIG. 2, the upstream end 22 is flush with the base 20 of the channel, for improved safety. The downstream face has a re-curve or change in curvature adjacent the trailing end, such that it terminates in a generally flat or horizontal portion 28. The trailing end 24 is spaced above the base 20 of the channel to form an abrupt vertical cut-off, as indicated in FIG. 2. The tail elevation factor TEF, or ratio of the height h1 of the trailing end 24 of the bed form above the base of the channel to the height h2 at the top or peak of the next bed form is designed to be in a predetermined range which has been found to produce standing waves. The range in TEF may be in the range from 0.125 to 0.75 while still producing rideable standing waves.

The weir 12 also extends upwardly from the base, with a trailing end at the inlet from reservoir 14. Spaced inlet side walls 30 extend from a location in reservoir 14 outwardly along opposite sides of weir 12. This has been found to smooth the water flow from the reservoir into the channel 10. The weir 12 is of an airfoil like shape, extending upwardly from the leading edge to a peak and then having a convex downward curvature up to trailing edge 32, which is also spaced above the base 20 of the channel.

In the embodiment of FIG. 2, the weir and bed forms 12 and 15 may be of any suitable sheet material construction, such as metal, strong plastic material, or thin concrete and have a hollow interior. The bed forms each have a pair of elongate side vents 34 along opposite sides of the bed form extending across the peak of the bed form, as best illustrated in FIGS. 1 and 2. Similarly, the weir 12 has a pair of elongate side vents 35 on its opposite sides, extending along part of the downwardly inclined face. The raised trailing ends of the weir and bed forms also each form a vent 36 extending across the width of the channel, which defines, together with side vents 34, a secondary flow path for water traveling along channel 10.

The weir and bed form may each be supported by pedestals under or adjacent the peak or highest point of the bed form, such as pedestals 42 as illustrated in FIG. 2. Shorter pedestals 44 are provided to support the tail end portion of the weir and bed forms. The pedestals 42 and 44 are adjustable in height, with the opposite sides of the weir and bed forms sliding against the channel side walls 17. In an exemplary embodiment, two spaced pedestals 42 and two spaced pedestals 44 are provided, with each pedestal being approximately one quarter of the bed form width inwardly from the adjacent side wall 17, and spaced apart from the other pedestal by a distance equal to half the bed form width. A greater number of pedestals may be provided if required for additional support.

In order to provide adjustability in the secondary flow, the adjustable pedestals or hydraulic rams 42 and 44 provide height adjusters for varying the bedform and tail elevation. In the illustrated embodiment, the weir and bed forms are each secured to the channel base at the leading end via a first pivot 38, and a trailing end portion of the weir and bed forms is formed as a separate section pivoted to the remainder at a second pivot 40. The first pedestal or hydraulic ram 42 acts between the base of the channel and the upstream pivoted portion of the weir and bed form, and the second pedestal or hydraulic ram 44 acts between the base of the channel and the pivoted trailing end portion of the weir and bed forms. The first height adjuster 42 will change the height of the peak of the weir or bed form, while the second height adjuster will change the elevation of the tail end of the weir or bed form, thus changing the vent height and the amount of secondary flow into or out of the tail end vent. The two pedestals can therefore be adjusted to vary the TEF ratio.

Figure 8:
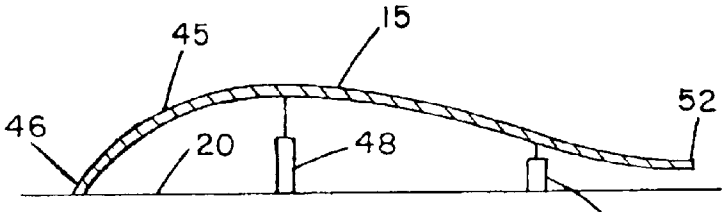
FIG. 8 is a sectional view illustrating another modified bed form with vent height adjustability.
Figure 9:
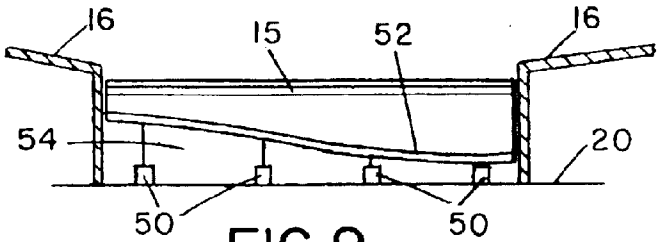
FIG. 9 is an end view of the bed form of FIG. 8, illustrating the height adjusters across the width of the vent.

FIGS. 8 and 9 illustrate a modified height adjustment mechanism for a bed form 15. In this case, rather than pivoted sections, each bed form is a hollow shell 45 formed from a flexible material and secured to the base 20 of the channel at the leading end 46 only. A first series of spaced height adjusters or hydraulic rams 48 extend at spaced intervals across the channel between the base of the channel and the inner surface of the shell 45 adjacent the peak of the bed form. A second series of spaced height adjusters or hydraulic rams 50 extend at spaced intervals across the width of the bed form adjacent the trailing end 52. Thus, the height adjusters 50 can be extended by different amounts, as in FIG. 9, in order to vary the height of the secondary passageway vent 54 across the width of the channel, to vary the standing wave properties. Useful waves can be created with different elevations across the width of the tail, for example one side may be at TEF=0 and the other side at TEF=0.8. This will still create a rideable wave. If the rams 50 are eliminated, the tail end of the bed form in FIG. 8 will be self-adjusting in height. This will create an oscillating wave which may be desirable in some cases.

Although the embodiments of FIGS. 1, 2 and 5 and FIGS. 8 and 9 have both weirs and bed forms with height adjustment devices, it will be understood that the apparatus may alternatively have fixed weirs, without any height adjusters, combined with adjustable bed forms, or may have both fixed weirs and fixed bed forms of the same general shape illustrated in the drawings. The adjustability is provided as a means for the operator to vary the wave conditions as desired. However, this may not be necessary in all cases. In general, the height h2 of the peak of the bedform is in the range of half of the inner flume height to 1½ times the inner flume height. In FIG. 5, the bedform height is approximately equal to the inner flume height. The inner flume height will be dependent on the application requirements, and in a water park attraction will be around ⅙ of the width of the flume.

In the apparatus illustrated in FIGS. 1, 2 and 5 and the alternative of FIGS. 8 and 9, water will flow from the reservoir in a primary flow path over the top of weir 12 and over each of the successive bed forms. At the same time, as indicated by the arrows 55, a secondary flow path is provided via the side vents and trailing end vents of the weir and bed forms. This secondary flow may be in either direction, i.e. from the trailing end back under the bed form and out at the peak of the bed form, or vice versa, depending on overall flow conditions. The provision of a secondary flow passageway through the bed form with a vent at the trailing edge of the bed form has been found to produce a stable standing wave 56 at the upstream face of the next bed form in the channel, as indicated in FIG. 2. The standing wave formation is enhanced by the provision of the shallow sloping side wall portions 16, which provide for some flow outside channel 10, as indicated in FIG. 1. In general, it is desirable that the flume be deeper in the channel or wave forming area 10 that contains the bed forms, and shallower just beyond the sides of the bed forms. This channels the water over the bed forms, and prevents too much water from escaping around the bed forms, while allowing the sides of the top portion of the standing wave to vent sideways. This is believed to help prevent the standing wave from decaying. The slight upward inclination out to the opposite sides 18 of the apparatus also helps to return water towards the center of the channel, helping additional wave formation at subsequent downstream bed forms.

Figure 17:
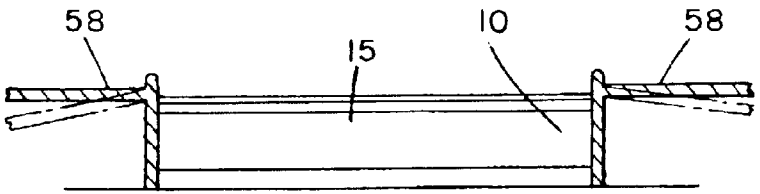
FIG. 17 is a sectional view similar to FIG. 5, but on a reduced scale, illustrating alternative side portions at opposite sides of the wave forming channel.

Although the opposite side portions 16 extending from opposite sides of the channel 10 and bed forms out to the outer sides 18 of the wave forming apparatus are shown in FIG. 5 as having a slight upward slope, they may alternatively be flat or even have a slight downward slope, as indicated in FIG. 17. FIG. 17 is a view similar to FIG. 5 of a modified flume structure in which flat, shallow outer side portions 58 are provided on opposite sides of the channel. The side portions 58 may alternatively be inclined slightly downwardly, as indicated in dotted outline. It has been found that the side portions 16 or 58 may have an inclination in the range from −5° up to +10°. Any angle in this range will have the desired effect of standing wave formation, although an inclination above 0° has the advantage of returning water back into the channel downstream of a first standing wave. Each side portion 16, 58 will have a width equal to at least 33% of the channel width for optimum wave sustaining effect. If the side portions are of different widths, one side may have a width of 25% of the channel width if the other side is wider.

The reservoir 14 will be continuously supplied with water via a suitable water-recirculating system of a type well known in the field of water park rides, in which water leaving the end of channel 10 is pumped back into the reservoir. The water re-circulation path may be beneath the channel 10, around one or both sides of the channel, or from other adjacent, linked rides.

The combination of features in FIG. 2, i.e. the specific bed form shape, the secondary passageways, and the shallow outer side portions 16, has been found on testing to lead to stable standing wave formation. This, in turn, will produce a wave riding water ride suitable for a water amusement park. The shallow outer side portions 16 also provide a convenient means for a rider to enter and exit the ride. It will be understood that the side vents 34, 35 and end vents 36 will be covered with gratings (not illustrated) for rider safety. The standing wave 56 will have a steep, unbroken, and stable wave face which is ideal for surfing. Variation of the trailing end vent height across the width of the bed form, as in FIG. 9, may be used, if desired, to create effects such as a sideways breaking wave. The height adjusters 42, 44 may be adjusted to produce a desired sequence of standing, stable waves.

Figure 3:
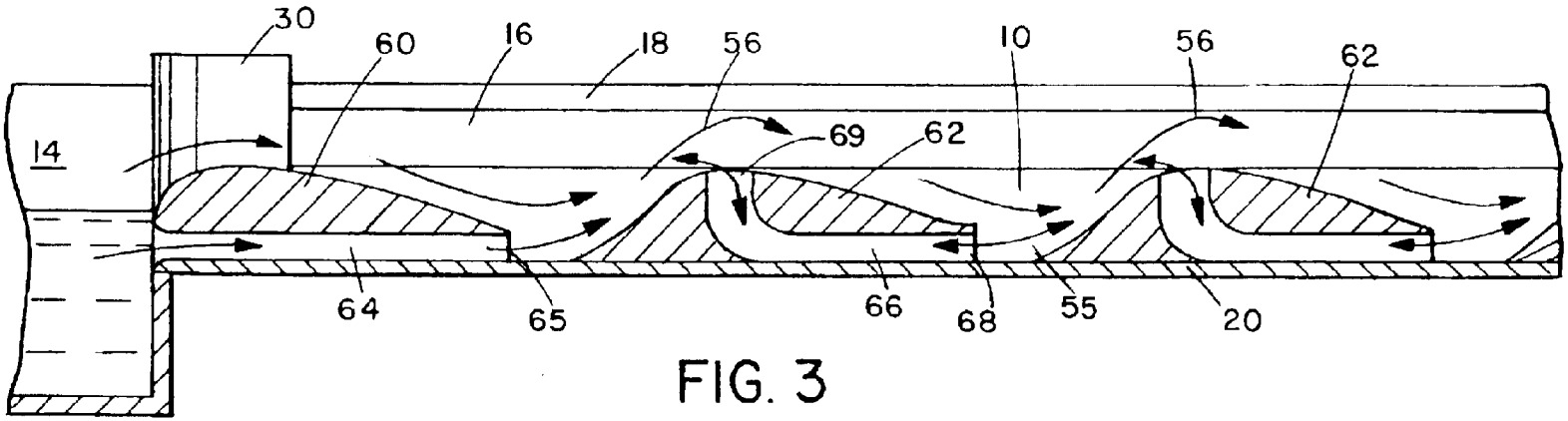
FIG. 3 is a sectional view similar to FIG. 2, showing a modified apparatus.

The weir and bed forms of FIGS. 2 and 8 are hollow shells which provide the secondary passageways back under the shell via suitable venting. Although the vents 34, 35 are spaced side vents in the illustrated embodiment, a vent extending across the top of the bed form may alternatively be provided. However, side vents will normally be preferable since this avoids the need for a safety grating across the entire top of the bed form. Additionally, instead of forming the weir and bed forms by separate shaped sheet-like members secured in the channel, they may alternatively be formed or molded integrally in the base of the channel as solid structures. FIG. 3 illustrates a modified wave forming apparatus according to another embodiment of the invention, in which the hollow shell weir and bed forms are replaced with a solid weir 60 and solid bed forms 62 spaced downstream of weir 60. The remainder of the apparatus, apart from the weir and bed forms, is identical to that of FIGS. 1 and 2, and like reference numerals have been used for like parts as appropriate.

The weir 60 is of identical surface shape to the hollow weir 12 of FIG. 2, but has a passageway 64 extending under the weir from the leading end to the trailing end 65, instead of the vent structure of FIG. 2. The bed forms 62 are also of identical shape to the bed forms 15 of FIG. 1, but the vent openings 34, 36 are replaced with passageways 66 through the bed forms. Each passageway 66 has one end opening 68 at the trailing end of the bed form, and another end opening 69 adjacent the peak of the bed form. Two openings 69 may be provided on opposite sides of bed form 62, with two spaced passageways 66 ending in a chamber extending across the width of the bed form and terminating at opening 68. Alternatively, a single opening 69 and passageway 66 may be provided. This arrangement will produce standing waves in an identical manner to the previous embodiment.

Figure 4:
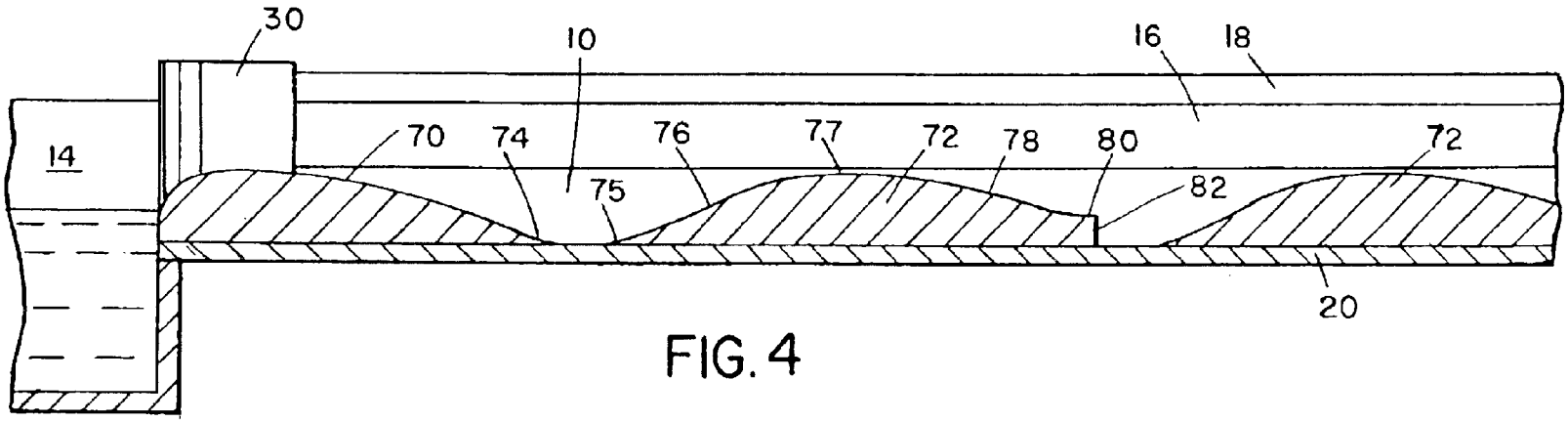
FIG. 4 is a sectional view similar to FIGS. 1 and 2 illustrating another embodiment of the wave forming apparatus.

FIG. 4 illustrates another modified embodiment, which has a similar solid weir and bed form arrangement to FIG. 3, but the secondary flow passageways are eliminated altogether. The structure in FIG. 4 is again identical to that of FIGS. 1 and 2, apart from the weir and bed forms, and like reference numerals are used for like parts as appropriate. In FIG. 4, a weir 70 is provided at the inlet end of channel 10 adjacent the reservoir outlet, and a series of spaced, solid bed forms 72 of identical shape are provided along channel 10 downstream of the weir. The weir 70 is of similar, airfoil shape to the weir 60 of FIG. 4, but rather than having an abrupt vertical cut off at the trailing edge, the trailing edge 74 of weir 70 continues to curve downwardly to meet the floor or base 20 of the channel at a smooth transition.

The bed forms 72 are of similar or identical shape to the bed forms 15 and 52 of the previous embodiments, with a leading edge 75 which has a flush transition with the base 20 of the channel, an upwardly inclined leading face 76, a peak 77, a downwardly inclined, concave trailing face 78, and a re-curved, substantially flat trailing end portion 80 with an abrupt vertical drop off face 82 at the trailing end of the bed form. It has been found that an abrupt drop off, such as vertical face 82 or the trailing end drop offs of FIGS. 2 and 3, helps to create a stable standing wave at the leading face of the next bed form. This effect will even occur without the secondary flow passageways, which is a simpler and less expensive structure, although it is less easily controllable and cannot be adjusted to produce different wave forms.

Figure 6:
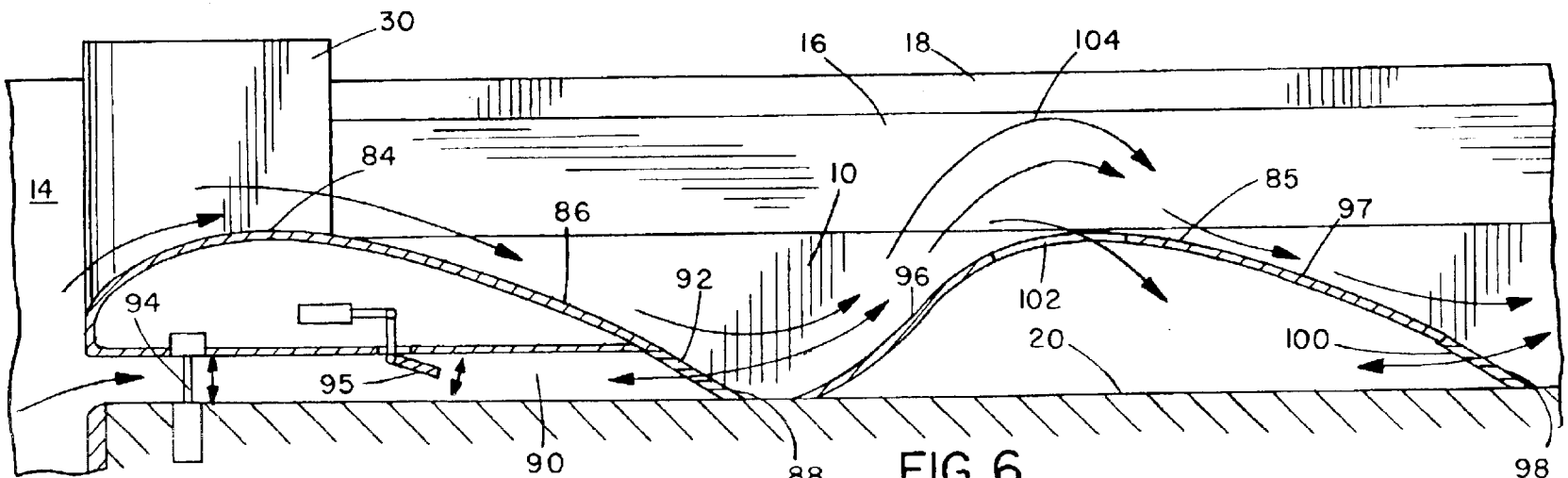
FIG. 6 is an enlarged sectional view similar to FIG. 2 illustrating another embodiment of the invention, with flow control mechanisms.

In the embodiments of FIGS. 1 to 5, the bed forms each have an abrupt trailing edge vertical drop off, with the trailing end of the bed form raised above the channel by a predetermined height, either with or without secondary flow paths for water through the bed form. FIG. 6 illustrates another alternative embodiment which has secondary water flow passageways, but no vertical drop off at the trailing edge of the weir or bed forms. Other parts of the wave forming apparatus are otherwise identical to the previous embodiments, and like reference numerals have been used as appropriate.

In the embodiment of FIG. 6, the channel 10 has a shaped weir 84 at the entry or reservoir end, and one or more bed forms 85 at spaced intervals downstream of weir 84. The weir and bed forms are of hollow shell construction, as in FIGS. 1 and 2, but may alternatively be of solid construction with formed passageways, as in FIG. 3. The weir is of generally airfoil like shape, and has a curved, convex trailing face 86 which extends down to merge smoothly with the base 20 of the channel at its trailing end 88. A secondary passageway 90 extends from reservoir 14 through the lower part of the weir up to the trailing end 88, with a safety grating 92 covering the open, trailing end of passageway 90. The passageway 90 may be provided with one or more flow control devices, such as height adjuster or hydraulic ram 94 and flap valve 95. The adjustable weir 84 of FIG. 6 may used in place of weir 12 of FIG. 2, or in any of the other embodiments to provide added adjustability of water flow at the leading end of the channel.

The bed form 85 has a shape similar to bed form 15 of FIG. 1, with a generally concave, upwardly inclined leading face 96 leading up to a peak, and a downwardly inclined, generally convex trailing face 97. However, the shape at the trailing end is different from the previous embodiments, since the trailing end cut off is eliminated, and the trailing face instead curves smoothly down to meet the base 20 of the channel at its trailing end 98. As in the previous embodiments, a secondary water flow passageway is provided through the bed form 85 via a vent opening 100 at the trailing end and vent openings 102 on opposite sides of the bed form which extend over the peak of the bed form. The vent openings will be covered with gratings for safety.

In this embodiment, the secondary passageway through the bed form, along with the shallow side portions 16 on opposite sides of the deeper channel containing the bed forms, and the shape of the bed forms, will tend to create a standing wave 104 at the first bed form 85 and each subsequent bed form in the channel, as in the previous embodiments. It will be understood that the weir and bed forms may alternatively be of solid construction with through passageways, as in FIG. 3.

Figure 7:
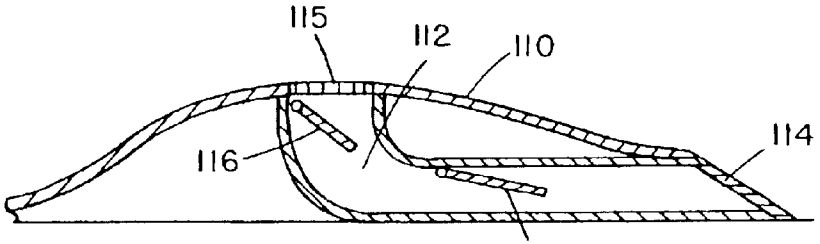
FIG. 7 is a sectional view of a single bed form forming part of a modified wave forming apparatus.

FIG. 7 illustrates an alternative bed form structure 110 which may be used in place of the bed forms 15 of the first embodiment. In this case, rather than permitting flow circulation in the entire area under the bed form, the flow is channeled through one or more passageways 112 via a vent or slot 114 at the trailing end of the bed form, and a vent or slot 115 adjacent the peak of the bed form. Each vent 114, 115 and the associated passageway 112 may extend across the width of the bed form, or two side slots may be provided as in FIGS. 1 and 2 to communicate via spaced passageways with a full width vent 115. Flow control flaps or valves 116 are provided in the passageway 112 to control the secondary flow, so that the size and stability of the subsequent standing wave can be controlled more readily.

Figure 10:
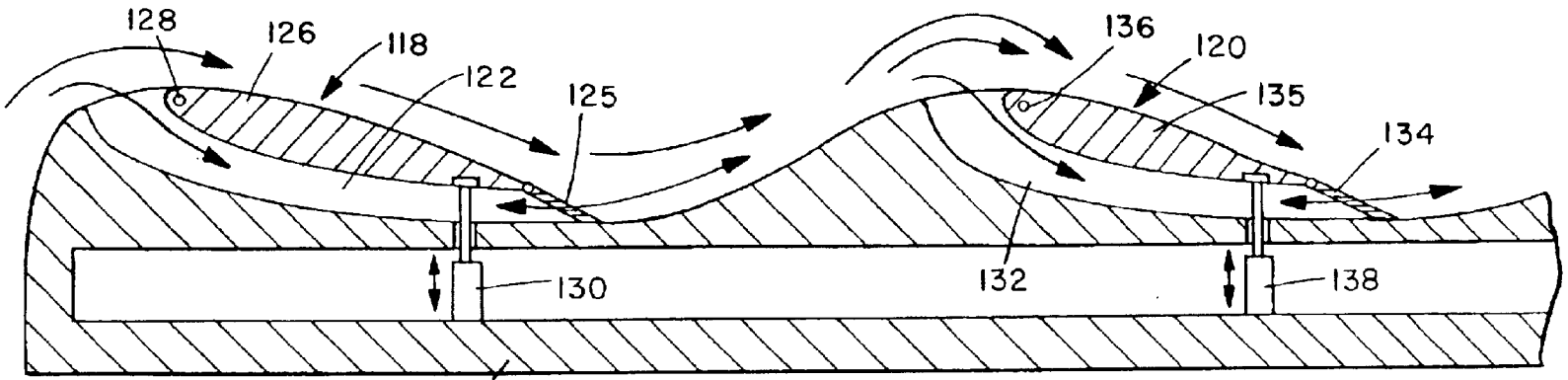
FIG. 10 is an enlarged sectional view similar to FIG. 6, illustrating another embodiment of the wave forming apparatus.

FIG. 10 illustrates a wave forming apparatus according to another embodiment of the invention, in which the weir 118 and bed forms 120 are actually molded into the base 121 of the channel, out of concrete or the like. The weir 118 has a passageway 122 extending from the leading end to a trailing end vent covered with a pivoted grating flap 125 which rests freely against the base 121. The upper portion 126 of the weir is pivoted at its leading end via pivot 128 and supported adjacent its trailing end by one or more hydraulic rams 130 spaced across the width of the passageway 122, acting between the base 121 and portion 126. Thus, the secondary flow rate can be readily adjusted simply by extending or retracting ram 130, either lifting the free end of portion 126 to increase the size of vent opening 124, or lowering portion 126 to reduce the vent size.

The bed form 120 is of similar shape to the previous embodiments, and has a secondary flow passageway 132 extending from a location adjacent the peak or highest point of the bed form to the trailing end of the bed form, wherein the vent is again covered with a pivoted grating flap 134 permitting height adjustment. An upper portion 135 of the bed form 120 is pivotally mounted at its leading end via pivot 136, and supported at its trailing end by one or more hydraulic rams 138 spaced across the width of the bed form, extending between base 121 and the portion 135. Again, this permits the size of the trailing end vent, and thus the amount of secondary flow in either direction through channel 132, to optimize the standing wave 139.

Figure 11:
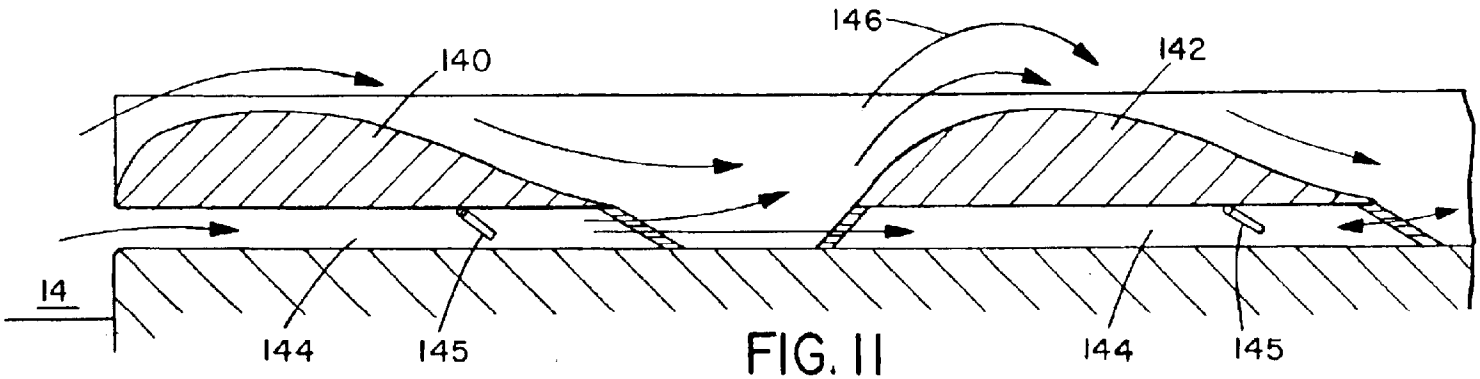
FIG. 11 is a view similar to FIG. 10 illustrating another embodiment of the invention.

FIG. 11 illustrates an alternative embodiment in which both the weir 140 and bed forms 142 have secondary flow passageways 144 extending from the leading end to the trailing end. Each passageway 144 has a flow control valve 145 for adjusting the amount of secondary water flow. The vent openings at each end of the bed form passageways, and the trailing end of the weir passageway, are covered with safety gratings. The bed forms are of similar shape to the previous embodiments, and will be mounted in an apparatus similar to that illustrated in FIGS. 1 and 2, with shallow side portions outside the channel containing bed forms 142. As in the previous embodiments, the arrangement is such that rideable standing waves 146 will form adjacent the peak of the first bed form 142 and each subsequent bed form.

Figure 12:
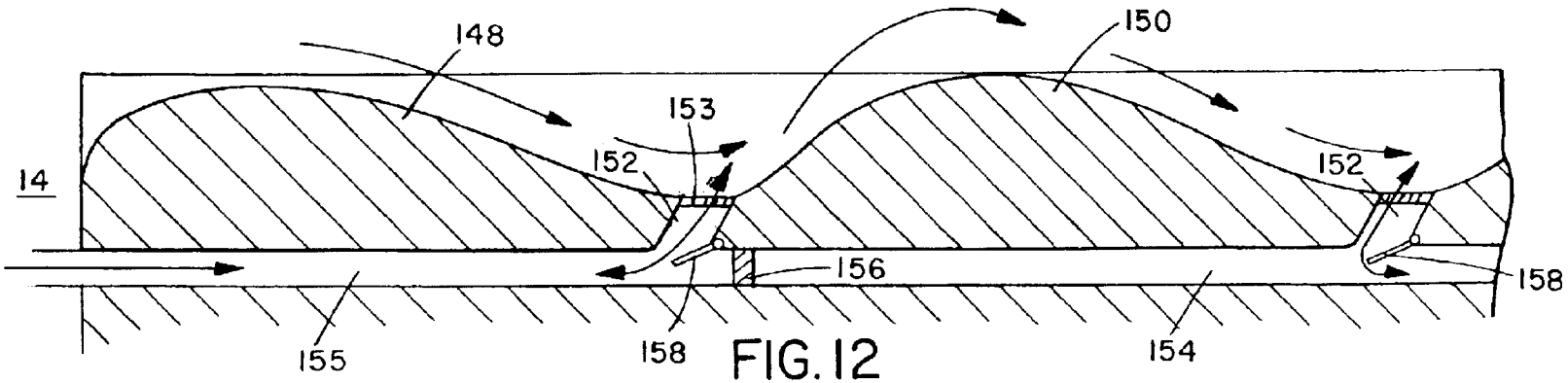
FIG. 12 is a view similar to FIGS. 10 and 11, illustrating another modified embodiment of the invention.

FIG. 12 illustrates another modification in which a weir 148 is followed by subsequent bed forms 150 of similar shape to the previous embodiments. However, in this case, rather than providing a secondary flow passageway extending from the peak or leading end of the bed form to the trailing end of the bed form, secondary water flow is instead provided via a vent passageway or opening 152 located between each adjacent pair of bed forms, and between the weir and first bed form.

The passageways 152 are each covered by a safety grating 153 at their open end and communicate with a single through passageway 154 extending through the base of the channel beneath the bed forms. A first portion 155 of the passageway beneath the weir is cut off from the subsequent portion of the passageway extending beneath the bed forms via wall 156. A flow control valve 158 is provided at the junction between each vent passageway 152 and the base passageway 152. This arrangement will also permit standing waves to form by permitting flow into and out of the area beneath the standing wave.

The embodiment of FIG. 12 will also be incorporated in an apparatus as generally illustrated in FIG. 1 with a central, deeper channel containing the weir and bed forms, and shallow side portions on each side of the channel. The valves 158 provide additional control for adjusting the properties of the standing waves formed over the bed forms.

Figure 14:
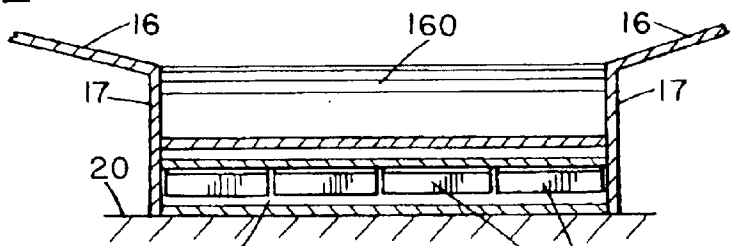
FIG. 14 is a sectional view on the lines 14—14 of FIG. 13.
Figure 13:
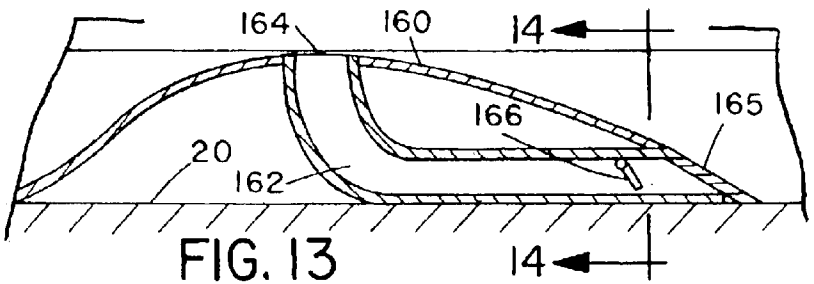
FIG. 13 is a view similar to FIG. 7, illustrating an alternative flow control.

FIGS. 13 and 14 illustrate another modified bed form 160 which may be used in place of the bed forms 15 of FIGS. 1 and 2 in a wave forming apparatus. The apparatus is otherwise identical to that of FIGS. 1, 2 and 5, and like reference numerals have been used for like parts as appropriate. In FIG. 13, the bed form is of similar shape to that of FIG. 6, although it may have a shape similar to that of FIG. 2, with a re-curved trailing end and a sharp vertical drop off. A secondary flow passageway 162 is provided from a vent opening or slot 164 at the peak of the bed form to a trailing end vent 165 covered by a grating. The trailing end vent 165 extends across the full width of the bed form, as indicated in FIG. 14.

A series of flap valves 166 are provided across the width of passageway 162 adjacent the trailing end vent opening. This allows the opening size to be varied across the width of the vent 165, to produce various effects in the subsequent standing wave formed downstream of bed form 160. For example, by closing the flaps 166 successively across the width of the vent 165, a sideways breaking wave may be produced. With all the flaps open, a stable standing wave is produced.

Figure 15:
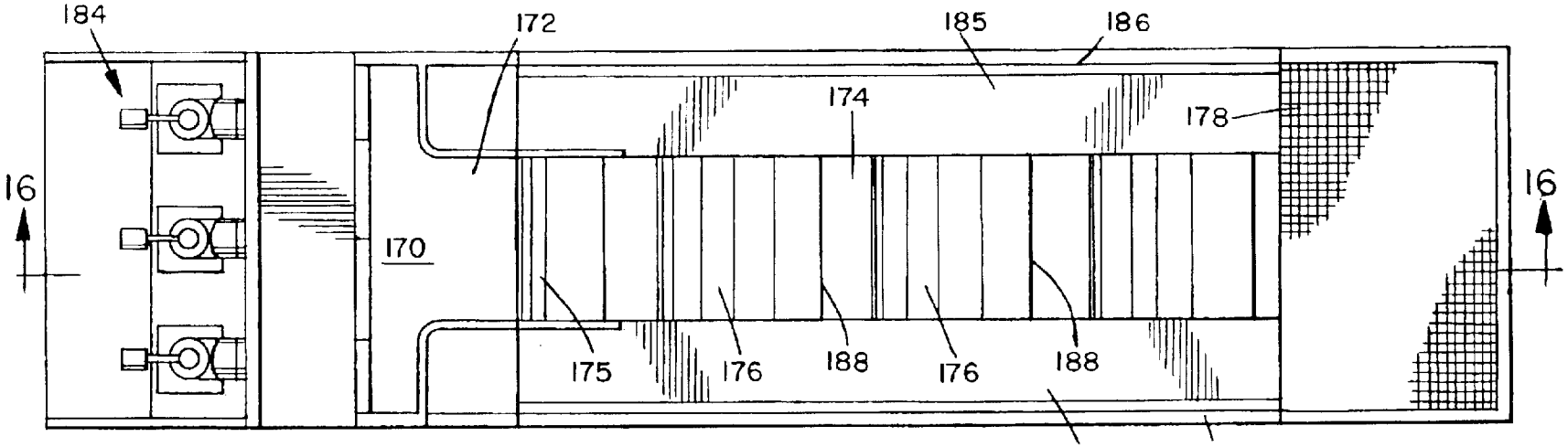
FIG. 15 is a top plan view of a wave forming apparatus according to another embodiment of the invention.
Figure 16:
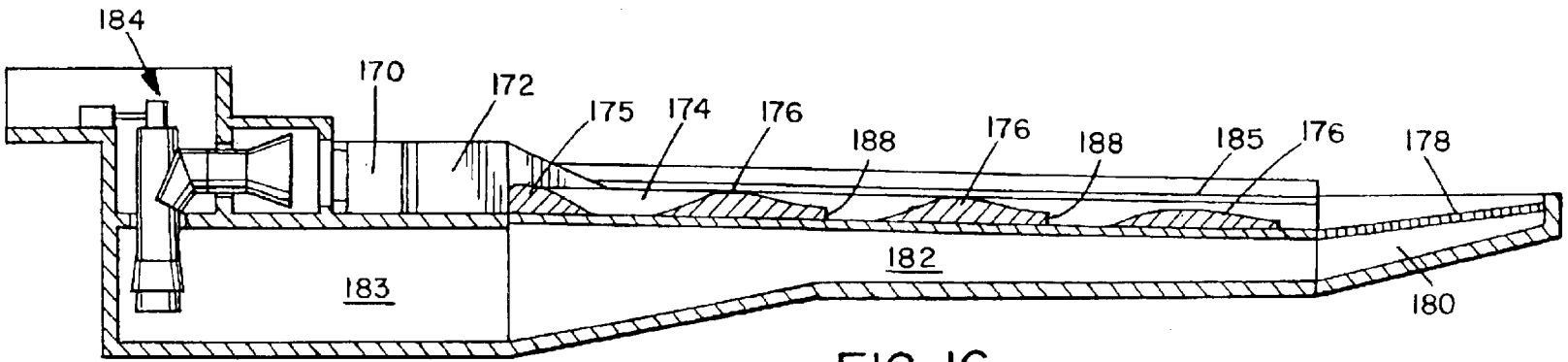
FIG. 16 is a sectional view on lines 16—16 of FIG. 15, illustrating the water re-circulation path.

FIGS. 15 and 16 illustrate a wave forming apparatus similar to that of FIGS. 1, 2 and 5, but showing a possible water re-circulation system for circulating water back to a reservoir at the inlet end of the apparatus. In this embodiment, a raised reservoir 170 at one end of the apparatus supplies water via an elongated inlet 172 to a wave forming channel 174 in which a weir 175 and a series of spaced bed forms 176 are provided. At the end of channel 174, water falls through grating 178 into a chamber 180, and is then re-circulated through a passageway 182 beneath channel 174 back to a chamber 183 beneath the reservoir, where it is re-circulated via pumping system 184.

It will be understood that other water re-circulation systems may be used, such as passageways around the sides of channel 174, or the outlet end of the wave forming apparatus may be connected to other water rides, and water may then be re-circulated from those rides back to reservoir 170. As in the first embodiment, shallow side portions 185 extend from each side of channel 174 to the outer sides 186 of the apparatus, and this may be inclined slightly upwardly, as in FIG. 5, or may be flat or inclined slightly downwardly. The bed forms 176 of FIG. 16 are solid shaped members similar to those of FIG. 4, without any secondary flow passageways but with an abrupt vertical cut off 188 at the trailing end. However, bed forms 176 may be replaced with any of the other alternative bed forms illustrated in FIGS. 1 to 14. The sides of channel 174 are straight, rather than flaring outwardly as in FIG. 1. However, they may alternatively taper outwardly or inwardly from the leading end to the trailing end of the channel.

In this apparatus, as in the previous embodiments, standing waves will be formed downstream of each waveform 176 at the next structure, i.e. the upstream face of the next successive waveform, or, in the case of the last waveform, at the upwardly inclined grafting 178. The formation of a standing wave over grafting 178 has some advantages. For example, after exiting the wave, the rider can easily stand up in the shallow water over the grafting in order to exit the ride. In another alternative embodiment, a wave forming apparatus may comprise a channel as in the previous embodiments with a series of alternating waveforms and graftings, with each wave being formed over a grafting. This will separate the riders more effectively. Each successive waveform and grafting may be stepped down from the preceding pair, to ensure adequate water flow through the channel.

In each of the above embodiments, water flows over and through a weir at the inlet end of the channel. However, flow may alternatively be provided through side channels extending along opposite sides of the weir, under the control of flap valves.

The wave forming apparatus in each of the above embodiments will create a high quality, more readily controlled standing waves. A combination of features produces the optimum wave conditions, with some or all of these features being used dependent on the desired form of the standing wave, and what degree of adjustability in the wave formation is required. One key feature is a sequence of two or more shaped bed forms, such that waves will tend to be formed at a leading face of the successive bed forms. However, this alone is not sufficient to form a stable standing wave. Another key feature in forming a standing wave is the provision of secondary flow beneath each bed form, with a vent for flow into or out of the secondary passageway immediately upstream of the desired wave forming location, prior to the leading face of the next bed form. This is believed to provide flow out of or into the space beneath the wave at the wave forming location, enhancing the stability of the wave.

The opposite end of the secondary passageway is provided in most cases at or adjacent the peak or highest point of the bed form, and may comprise a vent across most of the width of the bed form, or two elongated side vents on opposite sides of the bed form centered at the peak. A further feature which produces improved standing waves is the provision of a sharp, vertical cut off at the trailing end of the bed form, so that a trailing end is spaced above the floor of the channel. This alone, without a secondary passage, will result in some standing wave formation. However, standing waves are enhanced by providing both a secondary passageway and a sharp cut off, as in some of the embodiments illustrated above. The secondary passageway also provides a convenient means for adjusting the standing wave, by means of height adjusters to vary the height of the trailing end of the waveform, valves to vary the secondary flow, and the like, as illustrated in some of the above embodiments. Adjustment of the size of the trailing end vent across the width of the bed form may be used to create a breaking, curling, or pitching wave. A surge of secondary flow can be created by hinging the bed form so as to first cut off the secondary flow, and then lifting the trailing end of the bed form. By providing a flexible trailing end portion for the bed form, which can lift and lower freely based on flow conditions, an oscillating wave form can be produced.

The bed form shape in each of the above embodiments comprises a concave leading face, a curved peak, and a concave trailing face. This tends to produce a wave at the leading face of the next bed form. In some of the above embodiments, the trailing face continues down to blend smoothly with the base of the channel. However, wave forming is enhanced by providing a re-curve adjacent the trailing end of the bed form, to produce a substantially horizontal tail portion before an abrupt vertical drop off at a predetermined tail elevation factor, or TEF, as illustrated in FIGS. 2 to 4, 7, 8, 11, 12, and 16. This will even produce standing waves without the secondary passageway for adding or removing water beneath the formed wave, although optimum effects and adjustability are provided by the combination of a secondary passageway and sharp drop-off.

The flume cross-sectional profile in each of the above embodiments comprises a deeper central channel containing the weir and bed forms for producing waves, and shallower side portions extending outwardly from opposite sides of the channel. This channels the water over the bed forms and prevents too much water from escaping around the bed forms, while allowing the sides of the top portion of each standing wave to vent sideways. This helps to prevent the wave from decaying and enhances stability. The shallow side portions may be tapered slightly upwardly so as to return water back to the center of the channel, although they may alternatively be horizontal or tapered downwardly.

Figure 28:
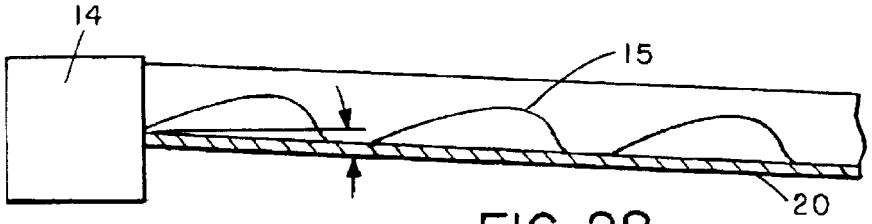
FIG. 28 is a sectional view illustrating a modified wave forming apparatus with a downwardly inclined bed.

In the previous embodiments, the flume or channel is shown as having a substantially flat or even bed or floor 20. However, it may be beneficial in some cases, particularly in channels with a plurality of bed forms for forming multiple standing waves, for the floor 20 to have a slight incline downwards from the channel or flume entrance to the end of the flume, as illustrated in FIG. 28. This inclination may be in the range of 0 to 4°. Rather than a constant inclination along the length of the flume, it may have a shallower portion extending from the entrance and a steeper portion at the lower end, or it may be curved to provide a change in depth along the flume.

Figure 18:
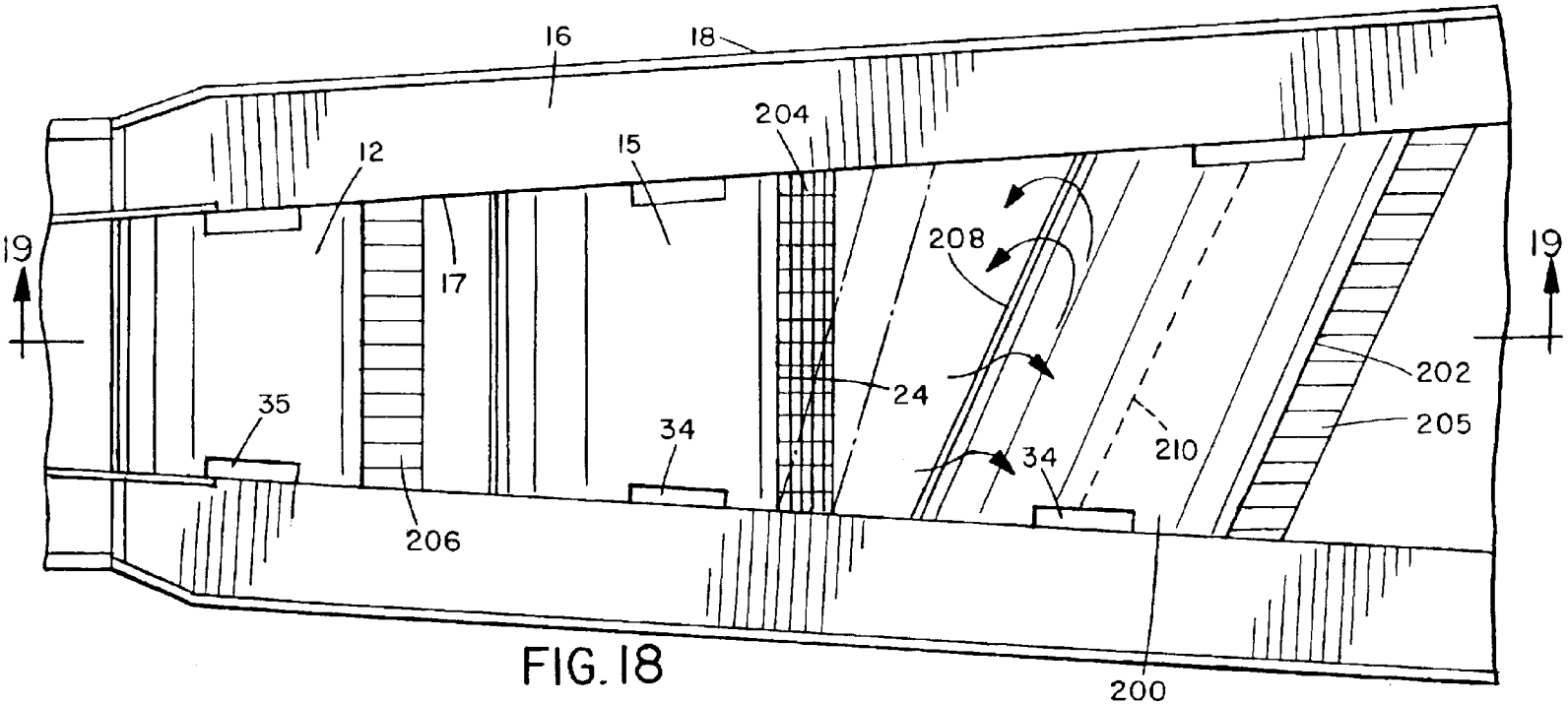
FIG. 18 is a top plan view of a wave forming apparatus according to another embodiment of the invention, for forming a standing, curling wave.
Figure 19:
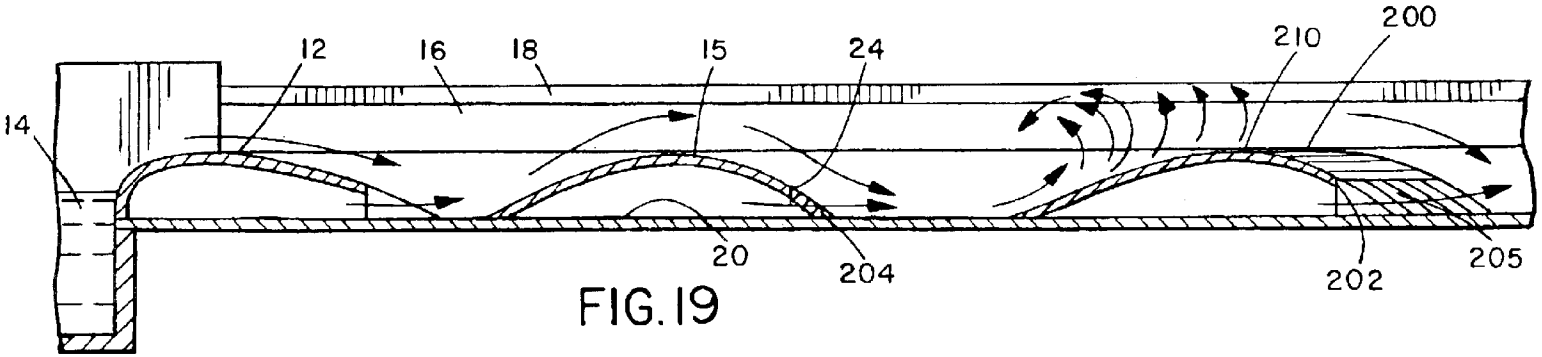
FIG. 19 is a cross-sectional view on the line 19—19 of FIG. 18.

FIGS. 18 and 19 illustrate a wave forming apparatus according to another embodiment of the invention. This apparatus is similar to the embodiment of FIGS. 1 and 2, and like reference numerals have been used for like parts, as appropriate. However, instead of a series of bed forms which are each perpendicular to the water flow direction, in this embodiment the last bed form 200 in the channel or flume 10 is oriented at an oblique angle to the water flow. Also, the floor 20 may have a slight declination of the order of 1 to 4°, as in FIG. 28.

As in the previous embodiments, channel 10 has a weir 12 at its inlet end connected to a supply of water in a reservoir 14. A first bed form 15 is positioned downstream of weir 12 in order to create a stable, standing wave. Oblique bedform 200 is positioned downstream of bedform 15. In alternative arrangements, a greater number of bedforms 15 may be provided prior to oblique bedform 200. The channel 10 is of tapering, gradually increasing width along its length, and may be provided with a water re-circulation system at its end as in FIGS. 15 and 16, or may intersect with another channel in other arrangements. Sloping side walls or entry/exit portions 16 extend from the opposite, vertical sides 17 of the wave forming channel or flume 10 to the outer sides 18 of the apparatus.

The weir and bed form 15, as well as the oblique bed form 200, are each of hollow shell construction, although they may be of any of the alternative constructions illustrated in the preceding embodiments. The bed forms 15 and 200 each incline upwardly to a peak, and then incline downwardly to a trailing end 24, 202 which is raised above the bed or base 20 of the channel. An inclined grating 204, 205 extends from the trailing end of each bed form down to the base 20. Grating 206 is also provided over the open, trailing end of the weir 12. The bed forms 15 and 200 each have a pair of elongate side vents 34 along opposite sides of the bed form and extending across the peak of the bed form. Similarly, the weir 12 has a pair of elongate side vents 35. The raised trailing end of each bed form and the vents 34 together form a secondary flow passageway for water through the bed form, as described in connection with the previous embodiments.

The oblique bed form 200 in the illustrated embodiment has an oblique or non-perpendicular leading edge 208 and a peak or ridge line 210 which is at the same oblique angle as the leading edge 208. The trailing edge 202 is shown at the same oblique angle as the leading edge and peak, although it may be at a different angle or even perpendicular to the flow. It is the angle of the leading edge and peak which are critical in creating a standing, curling wave or tube, and the orientation of the trailing edge will be dependent on what waveforms, if any, are to be provided downstream of the oblique bed form. It may also be advantageous to rake the trailing edge 24 of the bed form 15 immediately upstream of the oblique bed form 200 to provide the ideal hydraulic conditions for standing wave formation, for example as illustrated in dotted outline in FIG. 18. The angle of the leading edge 208 for creating a curling wave is in the range of 15 to 30 degrees from perpendicular to the flow direction, i.e. 105 to 120 degrees to the flow direction. In the exemplary embodiment, as noted above, the peak or ridge line 210 is at the same angle as leading edge 208, but could vary from this angle in order to create different wave effects.

In this embodiment, the first bed form 15 will create a standing wave with a stable wake as described above, while the oblique bed form will create a stable or standing curling wave. The raked leading edge and slant of the bed form 200 will give water a sideways velocity component which induces the more downstream side to break continuously while the more upstream side remains an unbroken standing wave. Thus, the curling wave will be created near the downstream end of the bed form and will extend across the bed form, as indicated in FIGS. 17 and 18. The water depth across the wave will vary from channel flow depth just prior to the wave to depths almost as high as the wave itself when measured under the peak. The standing tube or curling wave is induced to pitch out continuously by the bottom form of the bed and the ventilated shear wake created by the wave forming structure.

All the motion controls applied to the normal standing wave forming apparatus of the previous embodiments may be applied to the oblique bed form for forming the curling standing wave. Thus, the tail elevation, peak height, flow rate, channel depth, and other parameters may be varied in order to vary the wave.

Figure 20:
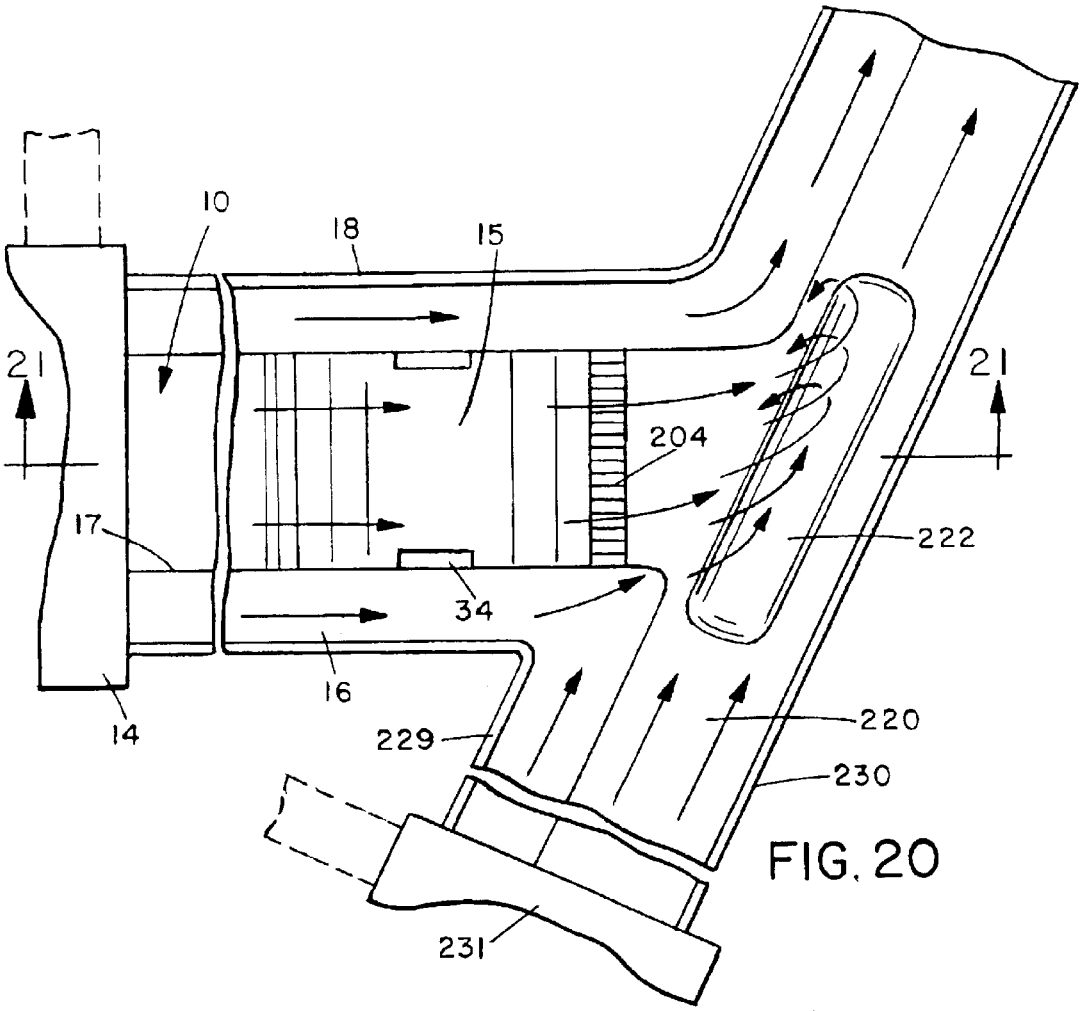
FIG. 20 is a top plan view of an alternative wave forming apparatus for forming a standing, curling wave.
Figure 21:
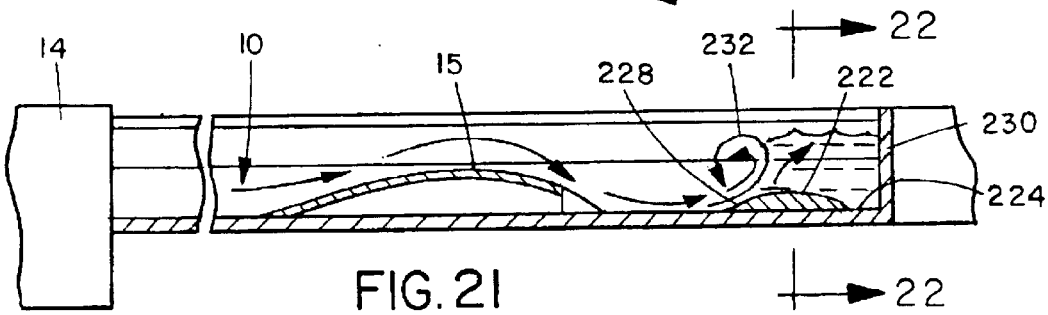
FIG. 21 is a sectional view on the line 21—21 of FIG. 20.
Figure 22:
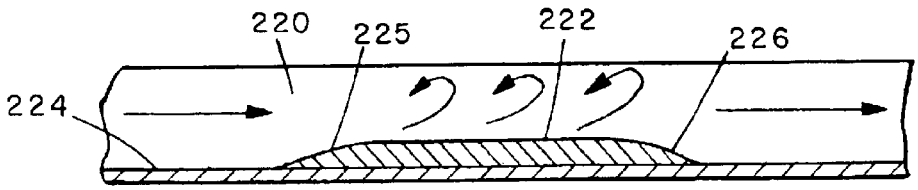
FIG. 22 is a sectional view on the line 22—22 of FIG. 21.

FIGS. 20 to 22 illustrate another embodiment of a wave forming apparatus for creating a standing, curling wave. In this embodiment, instead of providing an oblique bed form in the primary channel 10, another channel 220 is oriented to intersect the end of the primary channel 10 at an oblique angle. The water flowing in the secondary channel or river 220 will be deeper than the water flowing along primary channel 10, as indicated in FIG. 21. The primary channel 10 will have a weir and a series of bed forms 15 for creating stable standing waves, as in the first embodiment, with only the last bed form 15 being illustrated in FIGS. 20 and 21. The apparatus would also work with only one bed form 15 in the primary channel or flume 10, if no additional standing waves are desired.

A river bed form 222 is provided in the bed 224 of river or secondary channel 220. River or secondary channel 220 has an inner side wall 229 and an outer wall 230. The river is fed from a suitable water supply such as a reservoir 231. The bed form 222 in river 220 may be a solid or hollow bed form, and does not require any secondary flow channels. The bed form 222 is of generally rounded shape and is elongated in the river flow direction, as indicated in FIG. 22, with gradually tapering or smoothly contoured ends 225, 226 merging smoothly with the river bed 224. The leading surface 228 of the bed form 222 facing the primary channel 10 is of convex, rounded shape, as best illustrated in FIG. 21. The leading surface 228 will be similar in shape to the flume bed forms 15, and the height of the bed form 222 is less than that of the flume bed forms. The trailing surface shape is not critical and no tail elevation is required, because no downstream wave will be created after the curling wave. The bed form shape and length in the river flow direction are not critical. Overall height, position, and leading surface shape are the most critical factors. The ideal position for bed form 222 is at the confluence of the two water flows, but it may be adjusted upstream or downstream slightly for different effects. As noted above, the leading surface shape will be approximately the same as the leading surface shape of flume bed forms 15, but the peak will be of lower height.

In this embodiment, a curling wave 232 is created at the confluence of the faster flume flow exiting channel 10 with the deeper and slower river flow along channel 222. A stable wake is induced between bed form 15 and bed form 222. The combination of the stable wake and confluence of the two water flows creates a hollow curling wave suitable for riding in the tube of the wave. This wave can be controlled to advance or recede using the motion controls of the bed form apparatus, as described in detail in the previous embodiments, as well as by changing the flow rates and depths of the primary flume and/or river flow. The two reservoir sources 14 and 231 will provide the proper flow rate and velocity for each flow in order to create the standing, curling wave, and may be adjusted as needed. The curling wave can also be induced to break, advance, and recede by introducing traveling waves into the primary channel or the river flows.

The curling wave 232 is created in part by the depth of the water in the river behind the curling wave, or pooled water level, and partly by the oblique angle of the intersecting flow. Typical hydraulic jumps can be created by introducing faster moving water into slower moving water. The ideal level for the pooled water or intersecting river behind the curling wave 232 is a factor of 1.5 greater than the overall elevation drop from the channel base or flume bottom 20 at the entrance to channel 10 down to the flume bottom at the wave location. Adjusting the pooled water level behind curling wave 232 will change the size and characteristics of the curling wave. If the pooled water level is too high, say a factor of 2 greater than the flume elevation drop, the pooled water may cause the wave to decay. If the pooled water level falls to a factor of 0.7 or less of the flume elevation drop, the wave will be eliminated.

In an exemplary embodiment of the invention, the angle of intersection between the water flows in the primary flume or channel 10 and the river 220 was approximately 75 degrees (i.e. the angle between channel 10 and river 220, but it may be in the range from 30 degrees to 90 degrees. The range of suitable angles depends in part on the velocities of the two flows. For example, two sheet flows (flows with Froude numbers substantially in excess of 5, and approximately 35 and higher in current sheet flow technology practice) can be directed at each other to produce a water effect with the appearance of a curling wave. Any practical angles other than parallel can produce the effect. For standing wave formation, the river flow is typically slower, at subcritical (Froude number less than 1) or faster speeds, producing a hydraulic resistance to the faster flume flow. This, together with the oblique angle of intersection, tends to produce the standing curling wave, with the wave breaking continuously at the downstream end of the intersecting flows and the more upstream end forming an unbroken standing wave. Bed form 222 enhances the standing, curling wave formation. Flume water Froude numbers in the trough just ahead of the standing wave have Froude values in the 1 to 5 range. With standing waves, Froude numbers vary at every location in the flow and are subcritical (less than 1) at the standing wave peak. The river bed form 222 helps to control the position and formation of the standing curling wave.

Figure 23:
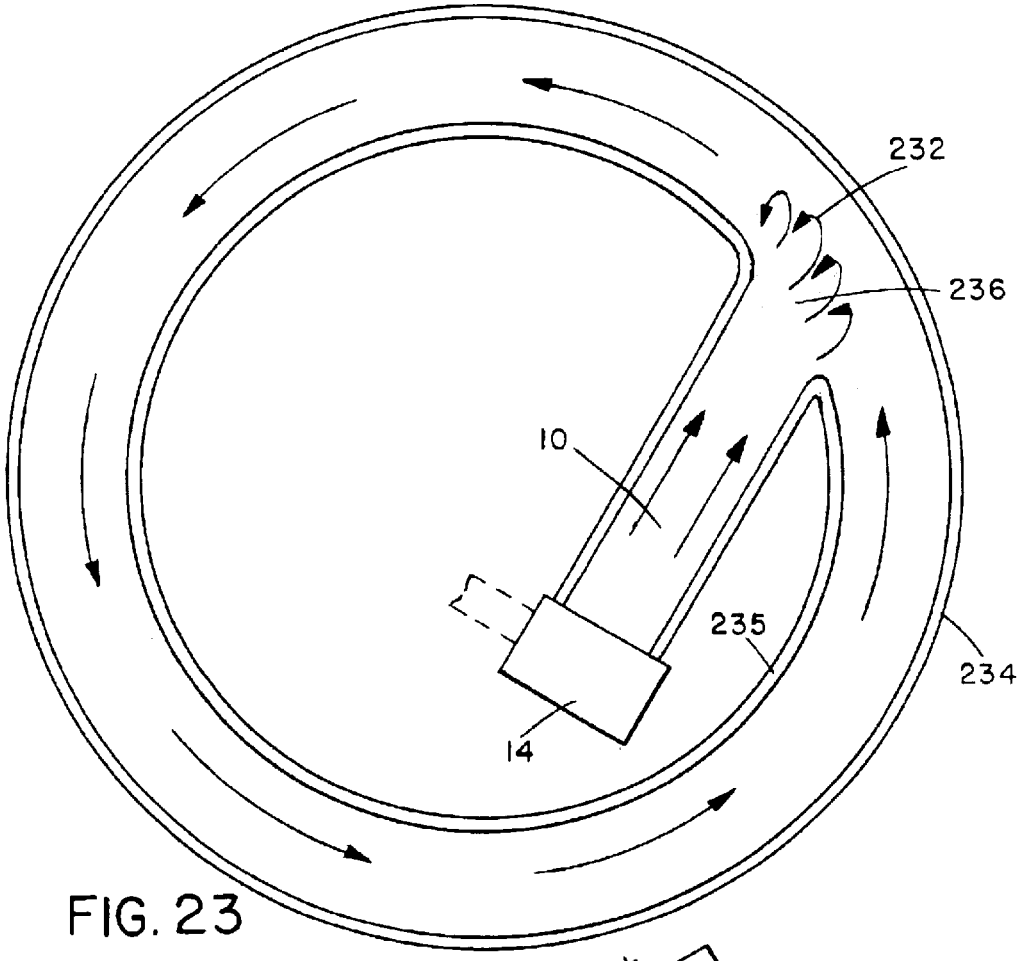
FIG. 23 is a top plan view of a modified wave forming apparatus which is self-circulating.

FIG. 23 illustrates a modification in which, rather than having an independently fed intersecting river flow, as in FIGS. 20 to 22, a continuous loop 234 is provided, with the primary channel 10 intersection the inner wall 235 of the loop at the desired oblique angle. This is a more efficient layout where the river flow is created by the inertia of the flume flow driving the combined flows in a continuous loop. For simplicity, the bed forms in primary channel 10 and in the loop at the intersection 236 between the primary channel and river flow are not shown, but will be identical to those illustrated in FIGS. 20 to 22 in order to create the standing curling wave 232, as well as one or more standing waves in the primary channel 10.

Figure 24:
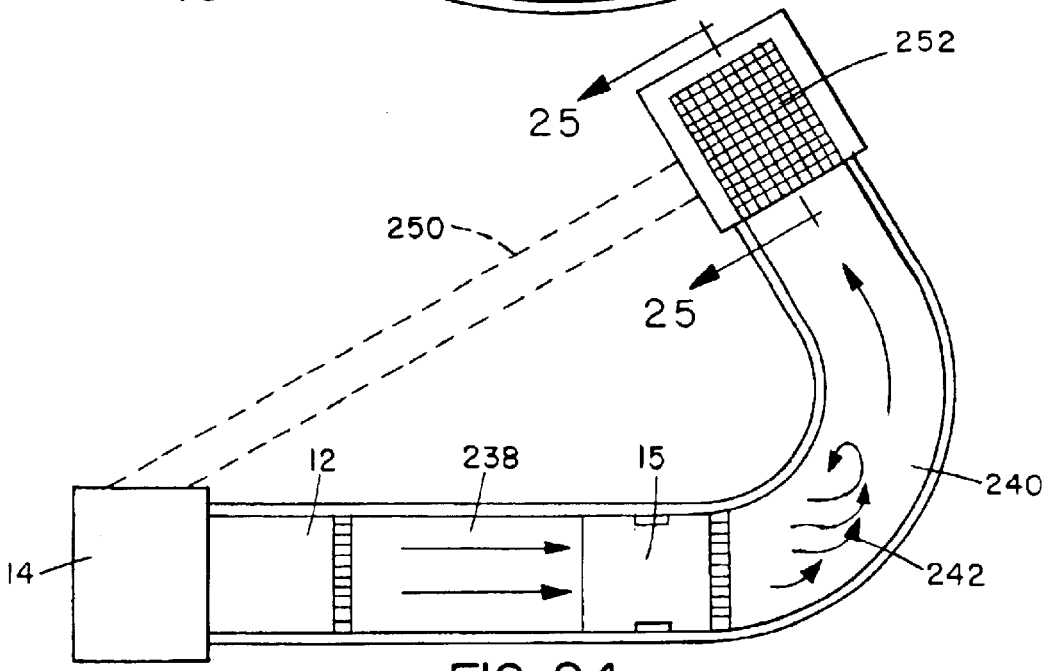
FIG. 24 is a top plan view of a wave forming apparatus according to another embodiment of the invention, in which the primary flume is curved to create a standing, curling wave.
Figure 25:
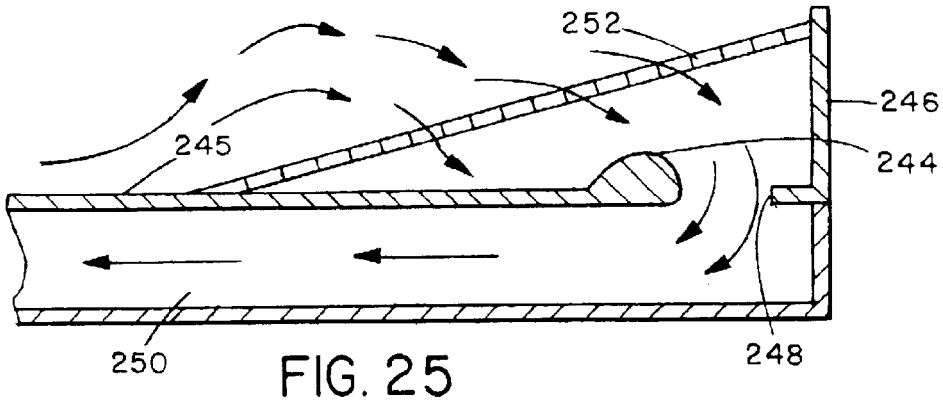
FIG. 25 is a sectional view on the line 25—25 of FIG. 24, illustrating the exit area of the apparatus of FIG. 24.

FIGS. 24 and 25 illustrate another alternative arrangement for creating a standing, curling wave. Instead of a secondary channel or river loop intersecting the primary channel 10, in this embodiment a primary channel 238 has a curve 240 immediately after a standing wave producing bed form 15, inducing a sideways flow component which will create a standing tubing wave 242. The water depth is changed at the curve 240 by providing a weir 244 at the outlet end of the channel which tends to back up water ahead of the tubing wave 242, as indicated in FIG. 25. The weir 244 is provided in the bottom or bed 245 of the channel 238 adjacent the end wall 246, and an outlet opening 248 allows water exiting the channel to flow back along water return passage 250. An inclined safety grille 252 covers the weir 244 and exit opening 248. The weir 244 will cause the water to back up, increasing the water depth and slowing the flow rate, which enhances the tubing wave formation.

Figure 26:
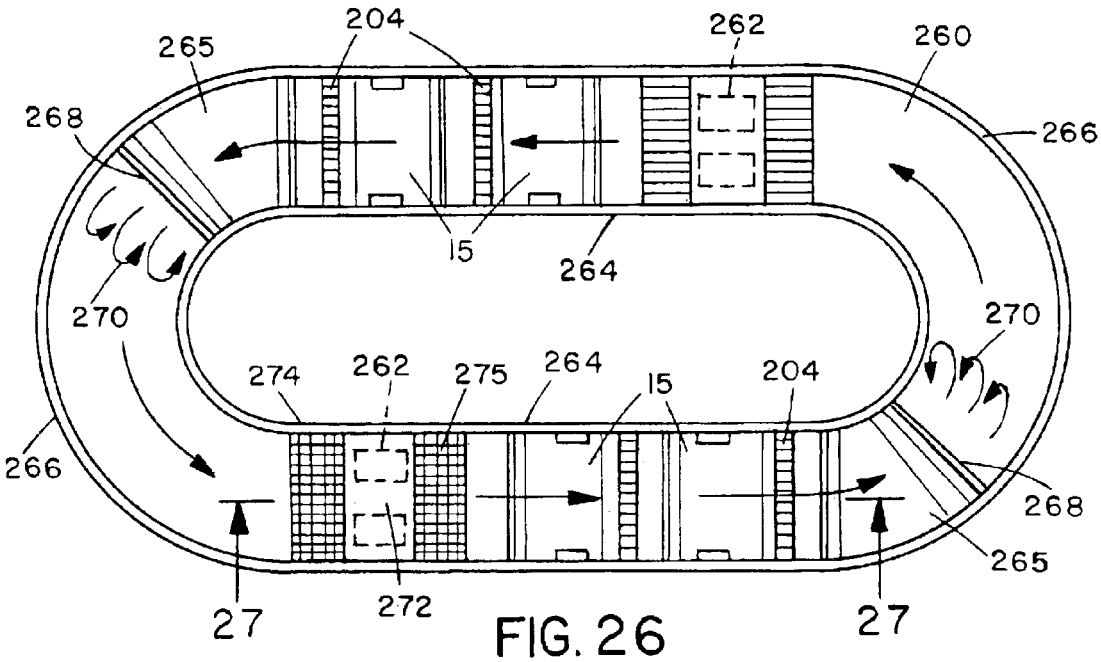
FIG. 26 is a top plan view of a river type wave forming apparatus according to another embodiment of the invention.
Figure 27:
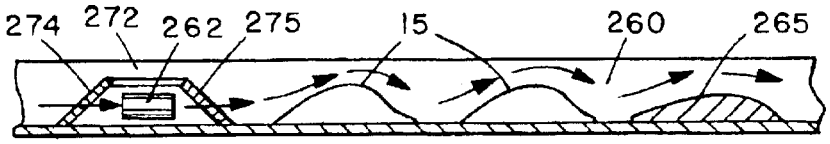
FIG. 27 is a sectional view on the line 27—27 of FIG. 26.

FIGS. 26 and 27 illustrate another alternative wave forming apparatus in which jet pumps replace the reservoir in creating the primary flume flow ahead of the bed forms. In this embodiment, the flume or channel 260 is in the form of an elongated river loop, with jet pumps 262 provided at the start of each straight side portion 264 of the loop in the flow direction. One or more standing wave forming bed forms 15 are provided in each straight side portion 264, and these will have venting as in the previous embodiments for creating standing waves. A second type of bed form 265 is provided at the start of each curled end 266 of the loop. This will have no venting and will be shaped at its trailing end 268 to conform with the bend in the channel, as indicated in FIG. 26. The bed forms 265 are lower in height than the bed forms 15. With this arrangement, one or more standing waves are produced at bed forms 15, while a curling standing wave 270 is produced at each curve or bend in the river loop.

The jet pump arrangement is illustrated in more detail in FIG. 27. As illustrated, jet pumps 262 will be arranged in pairs inside a housing having a flat upper wall 272, an inclined inlet grille 274, and an inclined outlet grille 275. Water is drawn through the inlet grille and out through the exit grille, as indicated, in order to circulate water at the desired flow rate. The river loop 260 may be elongated if a greater number of standing wave bed forms 15 is desired.

The enhanced, stable, stationary wave formation of this invention, as well as the standing curling wave formation of FIGS. 18 to 27, may have applications outside the field of water amusement parks. For example, suitably shaped bed forms may be provided at the spillway of a dam. This would allow for standing wave creation which would spread energy more quietly and reduce the mist that is produced in standard dam spillways. In turn, this would reduce erosion. In another related application, this bed form and flume technology can be provided in aqueducts and sumps to remove sediment and prevent sediment accumulation. Another possible application would be as a water based arcade attraction, of the type using radio controlled boats or surfers. In this case, the apparatus would be made at around one quarter of the normal water ride scale. It may also be used in a stand-alone water toy. The invention may also be used for a purely ornamental water attraction in parks and the like.

Although some exemplary embodiments of the invention have been described above by way of example only, it will be understood by those skilled in the field that modifications may be made to the disclosed embodiments without departing from the scope of the invention, which is defined by the appended claims.

I claim:

1. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form, the leading end of the bed form located at the base of the channel; and a secondary flow passageway provided in the channel, the secondary flow passageway having a first end communicating with the primary water flow at a location adjacent the trailing end of the bed form, and a second end communicating with the primary water flow at a location upstream of the first end.

2. The apparatus as claimed in claim 1, wherein the second end of the secondary flow passageway comprises a vent extending across the full width of the bed form.

3. The apparatus as claimed in claim 1, wherein the second end of the secondary flow passageway comprises spaced vents adjacent opposite sides of the bed form.

4. The apparatus as claimed in claim 3 wherein each vent extends across the upper portion of the bed form in the primary flow direction.

5. The apparatus as claimed in claim 1, wherein the bed form comprises an outer shell and a hollow interior, the outer shell having openings for secondary flow and the secondary flow passageway comprising a duct extending through the bed form and connecting the openings.

6. The apparatus as claimed in claim 1, including at least one valve in each secondary flow passageway for adjusting flow rate through the passageway.

7. The apparatus as claimed in claim 6, wherein the first end of the secondary flow passageway comprises a vent extending across at least a major portion of the width of the bed form, and a series of valves are provided across the width of the vent for adjusting the secondary flow across the width of the bed form, whereby the properties of the standing wave can be varied.

8. The apparatus as claimed in claim 1, wherein the bed form comprises a hollow shell and at least one pedestal is provided inside the shell extending between the base of the channel and the upper portion of the bed form.

9. The apparatus as claimed in claim 8, wherein the bed form is adjustably mounted and the pedestal is adjustable in height to vary the bed form height.

10. The apparatus as claimed in claim 8, wherein the bed form is formed of flexible material, the leading end of the bed form is secured in the base of the channel, and the trailing end of the bed form is free, and a second pedestal is provided adjacent the trailing end for supporting the trailing end above the base, the further pedestal being adjustable in height to vary the spacing of the trailing end above the base defining a first vent opening at the first end of the secondary flow passageway.

11. The apparatus as claimed in claim 10, wherein a series of second pedestals are provided across the width of the trailing end of the bed form, the second pedestals being independently adjusted whereby the size of the vent opening may be varied across the width of the bed form.

12. The apparatus as claimed in claim 1, wherein the trailing end of the bed form is spaced above the base of the channel to provide a vertical drop-off at the trailing end of the bed form, the trailing end being at a predetermined first height above the base of the channel.

13. The apparatus as claimed in claim 12, wherein there are at least two spaced bed forms in the channel and the upper portion of the second bed form is at a predetermined second height above the base of the channel, and the trailing end and upper portion together define a predetermined tail elevation factor (TEF) comprising ratio of the first height to the second height.

14. The apparatus as claimed in claim 13, wherein the tail elevation factor is in the range from 0.125 to 0.75.

15. The apparatus as claimed in claim 13, wherein the tail elevation factor is variable across the width of the channel.

16. The apparatus as claimed in claim 12, wherein the trailing end of the bed form is not secured to the base of the channel and is free to oscillate with changes in water pressure to produce an oscillating wave.

17. The apparatus as claimed in claim 1, wherein a series of identical bed forms are provided at spaced intervals along the channel, whereby a series of standing waves are formed.

18. The apparatus as claimed in claim 17, wherein the series of bed forms comprise a first bed form downstream of the weir extending perpendicular to the water flow direction and at least one oblique bed form downstream of the first bed form extending at an oblique angle to the water flow direction.

19. The apparatus as claimed in claim 18, wherein the oblique bed form has a leading end, a trailing end, and an upper portion, and a secondary flow passageway extending between a location adjacent the trailing end and a location adjacent the upper portion of the bed form.

20. The apparatus as claimed in claim 18, wherein the oblique bed form has a leading end, a peak, and a trailing end, and at least the leading end and the peak extend at an angle of 105 to 120 degrees to the water flow direction.

21. The apparatus as claimed in claim 1, wherein the channel has an outlet end spaced from the inlet end, and the side walls of the channel taper outwardly from the inlet end to the outlet end, whereby the channel is of variable width along its length.

22. The apparatus as claimed in claim 1, wherein the channel has an outlet end spaced from the inlet end, and the side walls of the channel extend in a straight line from the inlet end to the outlet end.

23. The apparatus as claimed in claim 1, including a grating downstream of the bedform, the channel having a chamber underneath the grating for re-circulation of water, whereby a standing wave is formed over the grating.

24. The apparatus as claimed in claim 23, wherein the grating is inclined upwardly in the water flow direction.

25. The apparatus as claimed in claim 1, wherein the channel has an outlet end and the base of the channel is inclined downwardly at an angle no greater than approximately 2.5 degrees between the inlet end and outlet end.

26. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the upstream face of the bed form being concave and the downstream face being concave.

27. The apparatus as claimed in claim 26, wherein the first end of the secondary flow passageway comprises a first vent extending across the width of the bed form.

28. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the second end of the secondary flow passageway being located at the upper portion of the bed form.

29. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the bed forms being of solid construction and the secondary flow passageway extending through each bed form.

30. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the bed form comprising an outer shell and a hollow interior, the outer shell having openings for secondary flow and the secondary flow passageway comprising the hollow interior of the bed form.

31. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and a flume having a first end, a second end, and outer sides, the channel containing the weir and bed forms extending along a central portion of the flume from the first end to the second end, and the flume having side portions on opposite sides of the channel extending from the respective channel side wall out to the opposite sides of the flume, the side portions of the flume being shallower than the channel.

32. The apparatus as claimed in claim 31, wherein each side portion is tapered upwardly from the channel side wall to the outer side of the flume.

33. The apparatus as claimed in claim 32, wherein each side portion is tapered at an angle of between 0° to 10° to the horizontal.

34. The apparatus as claimed in claim 31, wherein each side portion has a width equal to at least 33% of the channel width.

35. The apparatus as claimed in claim 31, wherein each side portion is oriented at an angle of between −5° to +10° relative to the horizontal direction outwardly from the side wall of the channel.

36. The apparatus as claimed in claim 31, wherein the outer side portions of the flume comprise ride entry and exit portions.

37. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the leading end of the bedform being flush with the base of the channel.

38. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the channel comprising a primary flume for containing a primary water flow, and having an outlet, end;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the apparatus further comprising a secondary channel intersecting the outlet end of the primary flume and defining a secondary water flow path across the outlet end of the primary flume, whereby a wave is formed at the intersection between the primary and secondary water flow paths.

39. The apparatus as claimed in claim 38, wherein the secondary channel is at an oblique angle to the primary flume.

40. The apparatus as claimed in claim 39, wherein the oblique angle between the primary flume and secondary channel is in the range from 90 to 150 degrees.

41. The apparatus as claimed in claim 39, wherein the secondary channel has an inlet end connected to a water supply.

42. The apparatus as claimed in claim 39, wherein the secondary channel comprises a continuous loop.

43. The apparatus as claimed in claim 39, including a secondary bed form in the secondary channel at the intersection, the bed form facing the primary flume for enhancing wave formation.

44. The apparatus as claimed in claim 43, wherein the secondary bed form is of similar shape to the bed form in the primary flume.

45. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end; and the channel having a bend in its length and the opposite side walls of the channel being curved along said bend.

46. The apparatus as claimed in claim 45, wherein the channel has an outlet end, and a weir at the outlet end for backing up water towards the bend to enhance wave formation at the bend.

47. A wave forming apparatus, comprising:

a channel for containing flowing water, the channel comprising a continuous loop having straight opposite side portions and curved end portions connecting the side portions;

the channel having a base and spaced side walls;

each side portion of the channel having first and second ends;

a water circulating pump at the first end of each side portion for circulating water in a predetermined direction around the loop;

at least one bed form in each side portion of the loop;

the bed form having a leading end and a trailing end, an upwardly inclined upstream face extending downstream of the leading end, an upper portion, and a downwardly inclined downstream face extending from the upper portion to the trailing end, the bed form extending outwardly to the side walls to define a primary water flow path over the bed form; and a secondary flow passageway provided in the bed form, the secondary flow passageway having a first end communicating with the primary water flow path at a location adjacent the trailing end of the bed form and a second end communicating with the primary water flow path at a location upstream of the first end.

48. The apparatus as claimed in claim 47, including a second bed form at the second end of each side portion, the second bed form extending into a bend in the channel.

49. The apparatus as claimed in claim 48, including at least one additional bed form in each side portion between the first mentioned bed form and second bed form.

50. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

the leading end of the bed form being located at the base of the channel; and the trailing end of the bed form being spaced above the base of the channel to define an abrupt vertical drop-off of predetermined height.

51. A wave forming apparatus comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form; and the trailing end of the bed form being spaced above the base of the channel to define an abrupt vertical drop-off of predetermined height, the abrupt vertical drop-off comprising a vertical end face of the bed form.

52. The apparatus as claimed in claim 51, wherein a second bed form is provided in the channel downstream of the first mentioned bed form, the upper portion of the second bed form is at a predetermined second height above the base of the channel, and the ratio of the height of the tail end of the first mentioned bed form to the second height comprises a predetermined tail elevation factor.

53. The apparatus as claimed in claim 52, wherein the tail elevation factor is in the range from 0.125 to 0.75.

54. The apparatus as claimed in claim 52, wherein the leading face of each bed form is of generally concave shape, and the trailing face has a first, convex portion extending from the upper portion, and re-curves into a generally flat portion adjacent the tail end of the bed form.

55. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

the trailing end of the bed form being spaced above the base of the channel to define an abrupt vertical drop-off of predetermined height;

the trailing end of the bed form being supported at a spacing above the base of the channel, the spacing comprising a first vent, and a secondary flow passageway extending from the first vent through the bed form, a second vent being provided in the bed form upstream of the first vent and communicating with the secondary flow passageway.

56. A wave forming apparatus, comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

the trailing end of the bed form being spaced above the base of the channel to define an abrupt vertical drop-off of predetermined height; and the leading end of the bedform being flush with base of the channel.

57. A method of forming waves, comprising the steps of:

directing water from a reservoir at one end of a channel having a base and spaced side walls into the channel and over a weir at the inlet end of the channel;

directing water flowing in the channel in a primary flow path over at least one bed form in the channel downstream of the weir, the bed form having a leading end and a trailing end, an upwardly inclined upstream face extending downstream of the leading end, an upper portion, and a downwardly inclined downstream face extending from the upper portion to the trailing end; and directing a secondary flow of water along a secondary flow passageway through the bed form having a first end communicating with the primary water flow at a location adjacent the trailing end of the bed form, and a second end communicating with the primary water flow at a location upstream of the first end, whereby a stable standing wave is formed downstream of the bed form.

58. A wave forming apparatus, comprising:

a primary channel for containing a flow of water traveling in a primary water flow direction, the channel having a base and spaced side walls and at least two bed forms projecting upwardly from the base of the channel at spaced intervals;

each bed form having a leading end and a trailing end, an upwardly inclined upstream face extending downstream of the leading end in the primary water flow direction, a peak, and a downwardly inclined downstream face extending from the peak to the trailing end, the bed forms each extending outwardly to the side walls to define a primary water flow path over the bed forms; and a secondary flow passageway provided in each bed form, each secondary flow passageway having a first end communicating with the primary water flow at a location adjacent the trailing end of the respective bed form and a second end communicating with the primary water flow path at a location upstream of the first end.

59. The apparatus as claimed in claim 58, including at least one oblique bed form downstream of the first bed form in the primary water flow direction extending at an oblique angle to the primary water flow direction.

60. The apparatus as claimed in claim 58, including at least one bend in the channel downstream of the bed forms.

61. The apparatus as claimed in claim 60, wherein the primary channel comprises a loop having opposite straight portions and curved end portions, and bed forms are located in each straight portion of the loop and at the junction between each straight portion and the respective curved end portion in the water flow direction.

62. The apparatus as claimed in claim 60, wherein the channel has an inlet end connected to a water supply and an outlet end after the bend, a weir is located at the outlet end for backing up water to the bend to enhance wave formation, and a re-circulation path is provided for circulating water from the outlet end back to the water supply.

63. The apparatus as claimed in claim 58, wherein the primary channel has an inlet end and an outlet end, and including a secondary channel containing a second flow of water and intersecting the outlet end of the primary channel at an oblique angle.

64. The apparatus as claimed in claim 63, wherein water flowing in the primary channel has a flow rate higher than that of water flowing in the secondary channel.

* * * * *